US012703939B2

(12) United States Patent
Kwon et al.

(10) Patent No.: US 12,703,939 B2
(45) Date of Patent: Aug. 11, 2026

(54) CLOTHING TREATMENT DEVICE

(71) Applicant: LG Electronics Inc., Seoul (KR)

(72) Inventors: Sunghun Kwon, Seoul (KR); Soowon Park, Seoul (KR); Kyuhwan Lee, Seoul (KR); Jinhong Park, Seoul (KR); Cheolu Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 852 days.

(21) Appl. No.: 18/003,072

(22) PCT Filed: Jun. 7, 2021

(86) PCT No.: PCT/KR2021/007049
§ 371 (c)(1),
(2) Date: Dec. 22, 2022

(87) PCT Pub. No.: WO2021/261801
PCT Pub. Date: Dec. 30, 2021

(65) Prior Publication Data

US 2023/0340713 A1 Oct. 26, 2023

(30) Foreign Application Priority Data

Jun. 22, 2020 (KR) ..... 10-2020-0075559

(51) Int. Cl.
*D06F 58/08* (2006.01)
*D06F 58/48* (2020.01)

(52) U.S. Cl.
CPC ..... *D06F 58/08* (2013.01); *D06F 58/48* (2020.02)

(58) Field of Classification Search
CPC ..... D06F 58/08; D06F 58/48; D06F 37/30; D06F 58/52; Y02B 40/00
See application file for complete search history.

(56) References Cited

U.S. PATENT DOCUMENTS 5,694,795 A 12/1997 Knopp

FOREIGN PATENT DOCUMENTS

CN 201012980 1/2008
CN 101328677 A 12/2008
CN 101377051 A 3/2009
(Continued)

OTHER PUBLICATIONS

Notice of Allowance in Korean Appln. No. 10-2020-0075559, mailed on May 16, 2025, 3 pages (with English translation).
(Continued)

*Primary Examiner* — Jessica Yuen
(74) *Attorney, Agent, or Firm* — Fish & Richardson P.C.

(57) ABSTRACT

A clothing treatment apparatus includes a cabinet, a cylindrical drum positioned inside the cabinet, a motor for generating a rotational force for rotating the drum, a rotating part configured to be rotated by the motor, a connection part configured to transmit the rotational force of the motor to the drum through the rotating part, a tension part positioned between the rotating part and the drum and configured to adjust the tension of the connection part, a bracket that is connected to the rotating part and rotatably supports the tension part; a first elastic member connected to the cabinet and to the rotating part or the bracket and configured to rotate the rotating part and the tension part in a first rotating direction, and a rotation preventing part configured to limit rotation of the rotating part and the tension part within a predetermined rotation angle.

20 Claims, 12 Drawing Sheets

(56) References Cited

FOREIGN PATENT DOCUMENTS

| | | | |
|---|---|---|---|
| CN | 105937161 | A | 9/2016 |
| JP | 2014-054387 | | 3/2014 |
| KR | 10-2006-0070256 | | 6/2006 |
| KR | 10-0664287 | | 1/2007 |
| KR | 10-0776445 | | 11/2007 |
| KR | 10-2009-0118759 | | 11/2009 |
| KR | 10-0999217 | | 12/2010 |
| KR | 10-2011-0105344 | | 9/2011 |
| KR | 10-2019-0128492 | | 11/2019 |

OTHER PUBLICATIONS

Office Action in Chinese Appln. No. 202180044072.4, mailed on Mar. 27, 2025, 16 pages (with English translation).

Extended European Search Report in European Appln. No. 21828804.1, mailed on Jun. 13, 2024, 6 pages.

International Search Report and Written Opinion in International Appln. No. PCT/KR2021/007049, mailed on Sep. 28, 2021, 14 pages (with English translation).

EQUATION 1

$$\sum M_1 = r_A \times F_A + r_C \times F_C - r_B \times F_B$$

(a)

EQUATION 2

$$\sum M = r_A \times F_A + r_C \times F_C - r_B \times F_B - r_D \times F_D$$

(b)

CLOTHING TREATMENT DEVICE

CROSS-REFERENCE TO RELATED APPLICATIONS

This application is a National Stage application under 35 U.S.C. § 371 of International Application No. PCT/KR2021/007049, filed on Jun. 7, 2021, which claims the benefit of Korean Application No. 10-2020-0075559, filed on Jun. 22, 2020. The disclosures of the prior applications are incorporated by reference in their entirety.

TECHNICAL FIELD

The present disclosure relates to a laundry treating apparatus. More specifically, the present disclosure relates to reducing a tension of a belt for connecting a drum and a motor to each other by minimizing a rotation of a motor shaft when the drum is driven, and thus, reducing a torque applied to the motor.

BACKGROUND

A laundry treating apparatus refers to all apparatuses that manage or treat laundry by washing or drying the laundry, bedding, or the like or removing wrinkles from the laundry, the bedding, or the like at home or in a laundromat. The laundry treating apparatus may include a washing machine, a dryer, a washing machine/dryer, a refresher, an iron, and a steamer.

For example, the washing machine is an apparatus for washing the laundry or the bedding. The dryer is an apparatus that removes moisture from the laundry or the bedding to dry the same. The washing machine/dryer is an apparatus that has washing and drying functions. The refresher is an apparatus for refreshing the laundry, such as removing odors and dust from the laundry or performing a static electricity generation preventing treatment. The iron is an apparatus for removing wrinkles from the laundry or creating necessary wrinkles for the laundry. The steamer is an apparatus that sterilizes the laundry using high-temperature steam without contact with a heating plate or delicately removes the wrinkles from the laundry.

In some cases, the dryer evaporates moisture contained in an object-to-be-treated by supplying hot air to the object-to-be-treated, such as the laundry or the bedding, put into a drum (or a tub). The air that evaporates the moisture of the object-to-be-treated in the drum and exits the drum contains the moisture of the object-to-be-treated, and thus, becomes to be in a high-temperature and high-humidity state. In this regard, a type of dryer is classified into a condensation type and an exhaust type based on a scheme of treating the high temperature and high humidity air.

The condensation-type dryer condenses the moisture contained in the high temperature and high humidity air via heat exchange while circulating the high temperature and high humidity air without discharging the same to the outside. On the other hand, the exhaust-type dryer discharges the high temperature and high humidity air directly to the outside. There is a structural difference in that the condensation-type dryer has a structure for treating condensed water, and the exhaust-type dryer has a structure for exhausting air.

A size of the drum directly affects a storage capacity of the object-to-be-treated. Therefore, it is inevitable to increase the size of the drum in order to increase the storage capacity of the object-to-be-treated. However, when the size of the drum increases, there is a possibility that a drum slip phenomenon (a phenomenon in which the drum and a drum belt that transmits a driving force to the drum idle) can occur with only a drum driving system disclosed so far.

In some cases, a structure for rotating the drum using the drum belt may not prevent the slip phenomenon caused by the increase in the size of the drum. Therefore, in a laundry treating apparatus equipped with a larger-sized drum than in the prior art, there is a need for a structure capable of smoothly transferring the driving force to the drum while suppressing the occurrence of the slip phenomenon or the like.

In some cases, a structure including an elastic member for preventing the slip phenomenon by further applying a tensile force to the drum belt. However, when the tensile force is excessive, torque of the motor and power consumption may increase.

SUMMARY

The present disclosure describes reduction of an increase in a tension of a drum belt by applying a structure that limits a rotation angle of a rotation shaft disposed in a motor.

The present disclosure describes reduction of power consumption for driving of a motor by reducing a torque applied to the motor.

The present disclosure describes a laundry treating apparatus having a structure capable of controlling a tension transmitted via a drum belt to be in an appropriate range while preventing a slip phenomenon between a drum and the drum belt.

The present disclosure describes an improvement of a reliability of a driver by achieving reduction of a load acting on the driver as a tension of a drum belt is reduced. The present disclosure describes stable constant-speed driving by reducing rotational vibration of a motor caused by a load change of a drum.

The present disclosure describes a double spring for connecting springs to both sides of a motor so as to prevent an excessive tension from being applied to a drum belt so as to reduce a load on the motor without causing a slip between the drum belt and the drum. Therefore, the present disclosure describes one or more implementations of an auto tensioner system that can actively change the tension of the drum belt based on a load change.

According to one aspect of the subject matter described in this application, a laundry treating apparatus includes a cabinet defining an external appearance of the laundry treating apparatus, a drum located inside the cabinet, the drum having an open front surface and an open rear surface, a motor configured to generate a rotational force for rotating the drum, a rotating portion configured to be rotated by the rotational force of the motor, a connecting portion that connects the rotating portion and the drum to each other and is configured to transfer the rotational force of the motor to the drum through the rotating portion, a tensile portion disposed between the rotating portion and the drum and configured to adjust a tension of the connecting portion, a bracket that is connected to the rotating portion and rotatably supports the tensile portion, a first elastic member having a first end connected to the cabinet and a second end connected to the rotating portion or the bracket, the first elastic member being configured to rotate the rotating portion and the tensile portion in a first rotation direction based on rotation of the drum, and a rotation preventing portion configured to limit a rotation angle of the rotating portion and the tensile portion in the first rotation direction to be less than a predetermined rotation angle.

Implementations according to this aspect can include one or more of the following features. For example, the rotation preventing portion can include a second elastic member having a first end connected to the cabinet and a second end connected to the rotating portion or the bracket, the second elastic member being configured to rotate the rotating portion and the tensile portion in a second rotation direction opposite to the first rotation direction. In some examples, the second elastic member can be located closer to one side surface of the cabinet than to another side surface of the cabinet. In some examples, the first elastic member and the second elastic member can be located at opposite sides with respect to the motor.

In some implementations, the rotating portion and the tensile portion can be configured to be disposed at original positions, respectively, before being rotated in the first rotation direction, and the rotating portion and the tensile portion are configured to, based on the drum being stopped, be rotated in the second rotation direction by the second elastic member to thereby return to the original positions, respectively.

In some implementations, the first elastic member can be configured to, based on the drum rotating at a preset target speed, apply a first spring force to the rotating portion or the bracket, and the second elastic member can be configured to, based on the drum rotating at the preset target speed, apply a second spring force to the rotating portion or the bracket, the second spring force being greater than the first spring force. In some examples, the rotation angle of the rotating portion and the tensile portion can be greater than 0 degrees and less than or equal to 2 degrees based on the drum rotating at the preset target speed.

In some implementations, the laundry treating apparatus can further include a rotation shaft configured to be rotated by the rotational force of the motor. The rotating portion can include a motor housing coupled to an outer circumferential surface of the motor, a support shaft that is parallel to the rotation shaft and coupled to the motor housing, a motor pulley coupled to the rotation shaft and configured to rotate together with the rotation shaft, a first pulley coupled to the support shaft and configured to rotate based on rotation of the motor pulley, a pulley belt that connects the motor pulley to the first pulley and is configured to transfer a rotational force of the motor pulley to the first pulley, and a second pulley coupled to the support shaft and configured to rotate together with the first pulley. In some examples, a diameter of the first pulley can be greater than a diameter of the second pulley.

In some implementations, the connecting portion includes a drum belt that connects an outer circumferential surface of the drum and the second pulley to each other. In some examples, a length of the drum belt is configured to increase based on rotation of the drum. In some examples, the tensile portion can include an idler pulley configured to increase a contact angle between the drum belt and the outer circumferential surface of the drum. In some examples, the drum belt is configured to, based on rotation of the drum, define (i) a tight side moving into the idler pulley and (ii) a slack side moving out of the idler pulley, where the drum belt is configured to have a first tension applied to the slack side and a second tension applied to the tight side and different from the first tension.

In some implementations, the laundry treating apparatus can further include a rotation shaft configured to be rotated by the rotational force of the motor, and a base that defines a bottom surface of the cabinet. The rotating portion can include a motor housing coupled to an outer circumferential surface of the motor, a support shaft that is parallel to the rotation shaft and coupled to the motor housing, a motor pulley coupled to the rotation shaft and configured to rotate together with the rotation shaft, a first pulley coupled to the support shaft and configured to rotate based on rotation of the motor pulley, a pulley belt that connects the motor pulley and the first pulley to each other and is configured to transfer a rotational force of the motor pulley to the first pulley, and a second pulley coupled to the support shaft and configured to rotate together with the first pulley. The motor can include a rotation shaft support that surrounds a circumference of the rotation shaft and rotatably supports the rotation shaft, where the base includes a motor support that protrudes from the base and supports the rotation shaft support to thereby enable the rotation shaft support to rotate by the rotation angle in the first rotation direction together with the bracket.

In some examples, the bracket can include a housing-coupled portion fixed to a side of the motor housing, where the housing-coupled portion defines a first through-hole that receives the rotation shaft and the rotation shaft support, and a second through-hole that is recessed from an outer surface of the housing-coupled portion toward the first through-hole and receives the support shaft. The bracket can further include a tensile portion-coupled portion that extends from the outer surface of the housing-coupled portion in a direction away from the first through-hole and rotatably supports the tensile portion. In some examples, the bracket can further include a first coupled portion that protrudes from the housing-coupled portion and is coupled to the first elastic member, where the first coupled portion is located between the first elastic member and the second through-hole.

In some implementations, the rotation preventing portion can include a stopper located at the motor support and configured to limit a rotation angle of the rotation shaft support to be less than the rotation angle of the rotating portion and the tensile portion. In some implementations, the rotation preventing portion can include a stopper disposed adjacent to the first elastic member, where the stopper includes a protrusion configured to limit a rotation angle of the rotating portion, the tensile portion, and the bracket to be less than the predetermined rotation angle based on the rotating portion, the tensile portion, and the bracket rotating in a direction toward the first elastic member.

In some implementations, the rotating portion includes a plurality of pulleys and a pulley belt that connects the motor to the plurality of pulleys, where the tensile portion includes an idler pulley disposed between the drum and the plurality of pulleys and spaced apart from the plurality of pulleys, and the connecting portion includes a drum belt that extends along at least a portion of the plurality of pulleys, the idle pulley, and an outer circumferential surface of the drum. In some implementations, the rotating portion includes a motor housing that accommodates the motor, where the second end of the first elastic member and the second end of the second elastic member are coupled to the motor housing. In some implementations, an increase in the tension of the drum belt can be reduced by applying the structure that limits the rotation angle of the rotation shaft disposed in the motor.

In some implementations, power consumption for the driving of the motor can be reduced by reducing the torque applied to the motor.

In some implementations, the laundry treating apparatus has the structure capable of controlling the tension transmitted via the drum belt to be in the appropriate range while preventing the slip phenomenon between the drum and the drum belt.

In some implementations, the reliability of the driver can be improved by achieving the reduction of the load acting on the driver as the tension of the drum belt is reduced.

In some implementations, the stable constant-speed driving can be achieved by reducing the rotational vibration of the motor caused by the load change of the drum.

Figure 9:
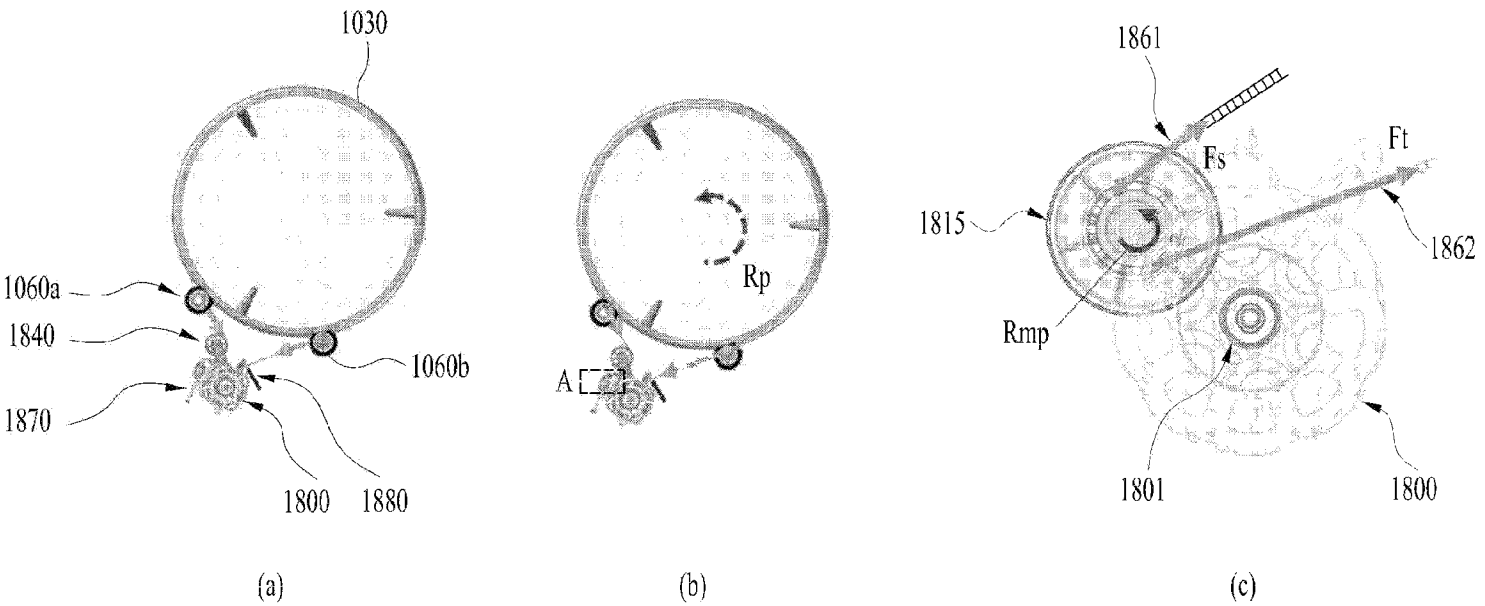

(a) in FIG. 9 is a schematic diagram for illustrating a tension applied to a rotating portion when a drum is stopped. (b) in FIG. 9 is a schematic diagram for illustrating a tension applied to a rotating portion by a drum belt when a drum rotates at a normal speed. (c) in FIG. 9 is a schematic diagram for illustrating that a tension applied to a rotating portion by a drum belt varies when a drum rotates at a normal speed.

Figure 10:
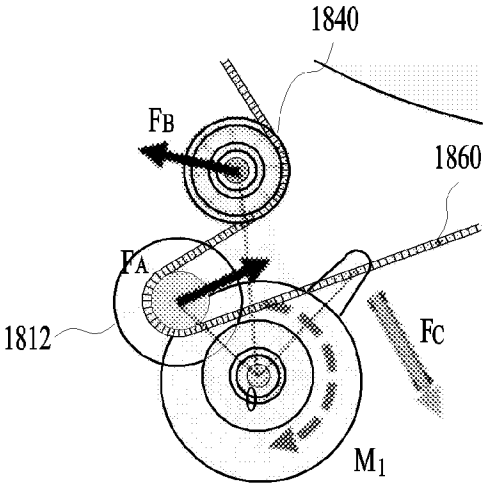
Figure 10:
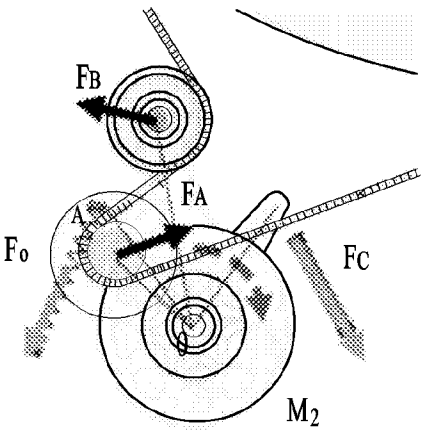

(a) in FIG. 10 is a free body diagram in a case in which only a first elastic member is present. (b) in FIG. 10 is a free body diagram in a case in which a second elastic member is present.

Figure 11:
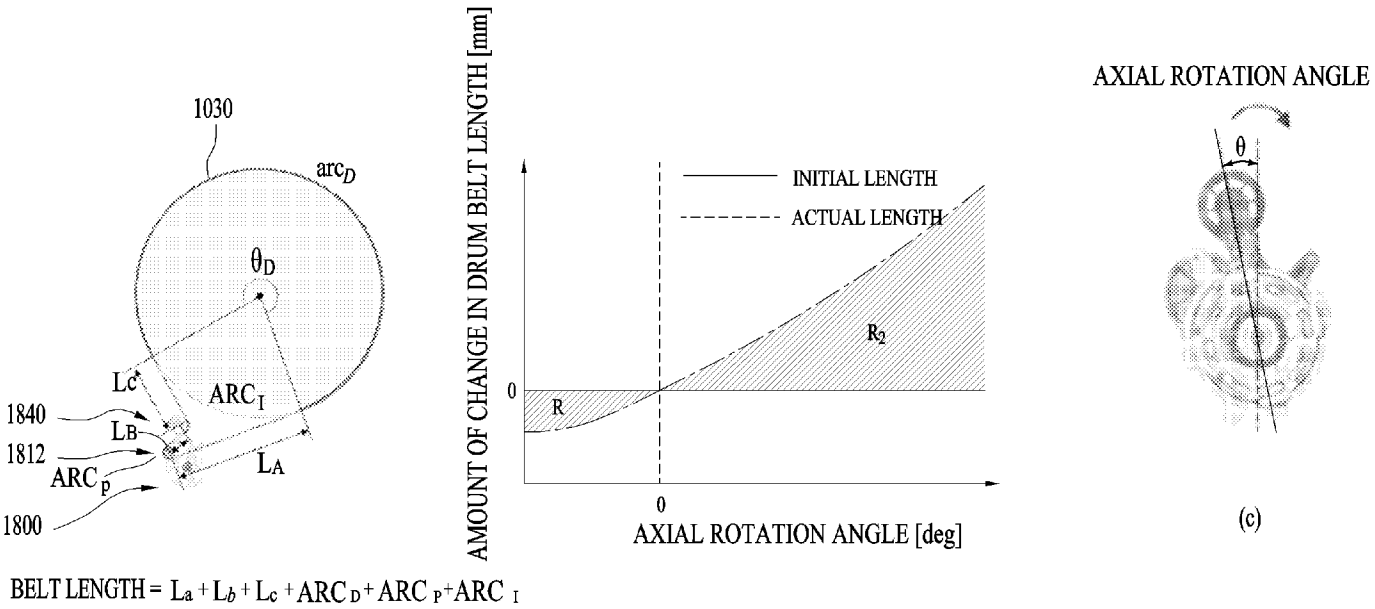

(a) in FIG. 11 illustrates a length of a drum belt formulaically. (b) in FIG. 11 is a graph showing that a drum belt is tensioned and relaxed based on a rotation angle of a rotation shaft. (c) in FIG. 11 is a diagram for definition of a rotation angle of a bracket and a tensile portion when a drum rotates.

Figure 12:
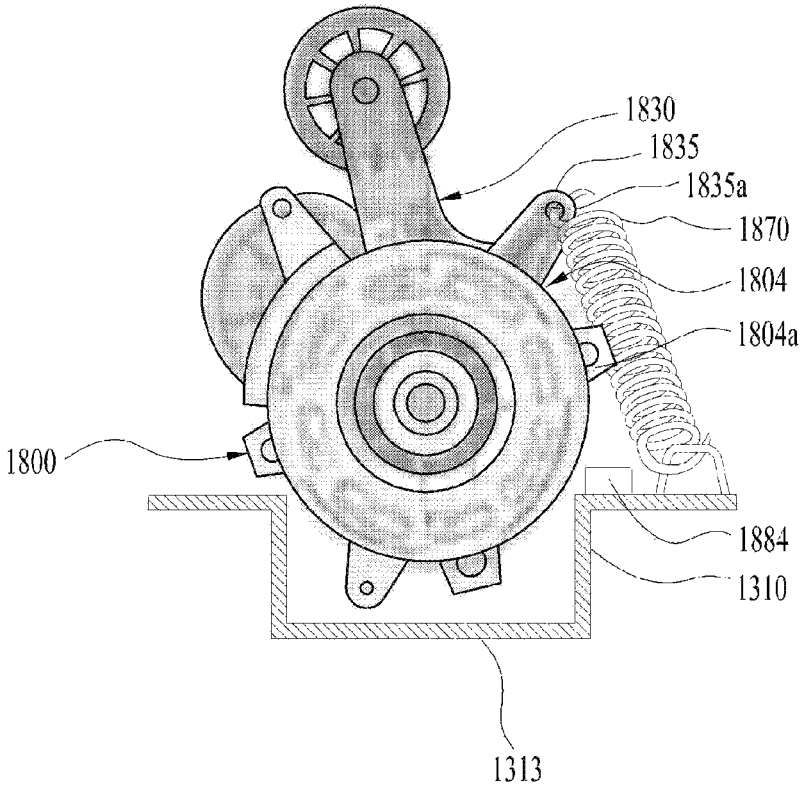

FIG. 12 shows an example of a stopper of a rotation preventing portion.

DETAILED DESCRIPTION

Hereinafter, one or more implementations of the present disclosure will be described in detail with reference to the accompanying drawings. A configuration of a device or a method for controlling the same to be described below is only for describing an implementation of the present disclosure, not for limiting the scope of the present disclosure, and reference numerals used the same herein refer to the same components.

Figure 1:
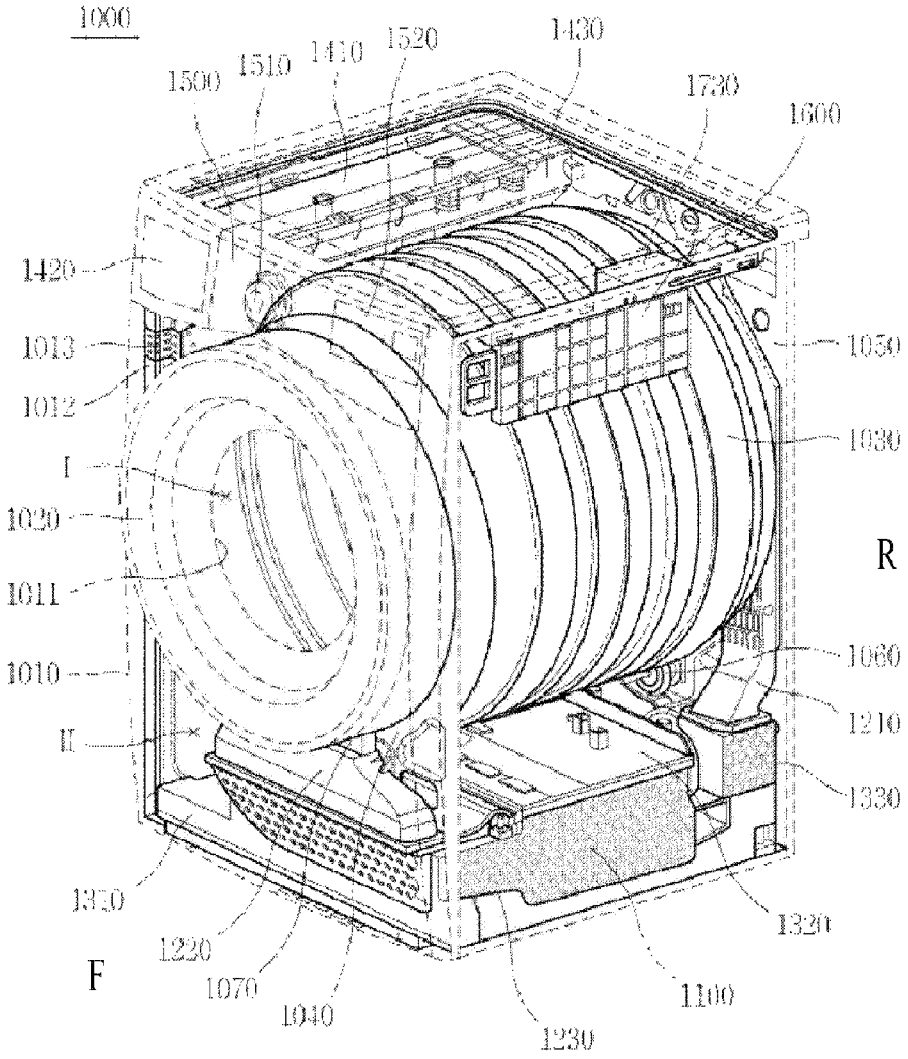
FIG. 1 shows an example of a laundry treating apparatus.

FIG. 1 illustrates an example of a laundry treating apparatus 1000. A cabinet 1010 can define an external appearance of the laundry treating apparatus 1000. The cabinet 1010 can be formed as multiple plates constituting a front surface, a rear surface, left and right side surfaces, a top surface, and a bottom surface of the laundry treating apparatus 1000 are coupled to each other. An inlet 1011 can be defined in a front surface of the cabinet 1010 such that an object-to-be-treated can be introduced into a drum 1030.

Herein, a side on which the inlet 1011 is located refers to a front side F of the laundry treating apparatus 1000, and a side opposite thereto refers to a rear side (R).

Figure 3:
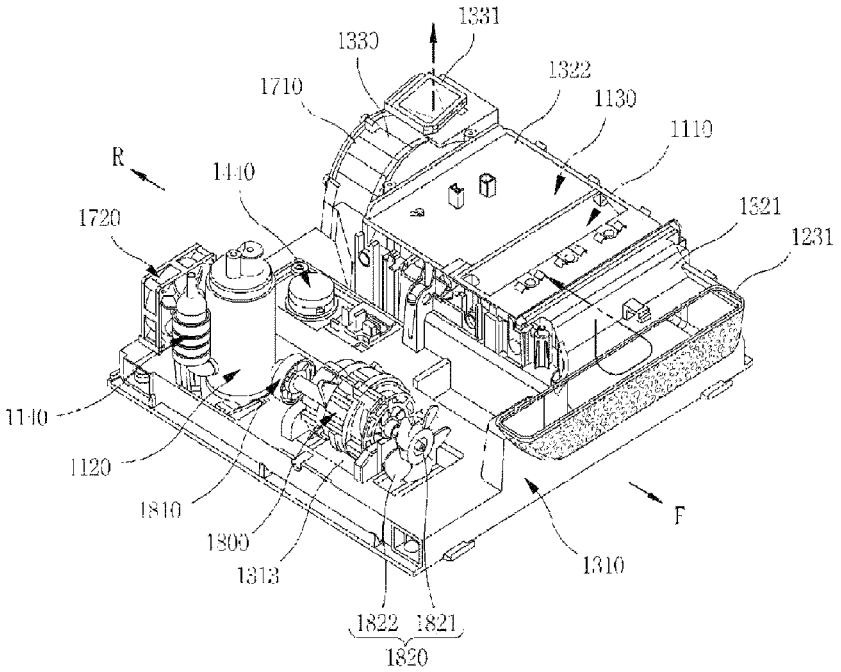
FIG. 3 shows an example of a base and parts mounted on the base.

In particular, because a bottom surface of the cabinet 1010 forms a floor surface of the cabinet, the bottom surface of the cabinet 1010 can also be referred to as a base 1310 (see FIG. 3). Unlike the front surface, a rear surface, left and right side surfaces, and a top surface of the cabinet, the base 1310 can be removed from the cabinet and can provide a space for installing mechanical parts necessary for driving the laundry treating apparatus 1000.

A door 1020 can be formed to open and close the inlet 1011. The door 1020 can be pivotably coupled to the cabinet 1010 by a hinge. The door 1020 can be partially made of a transparent material. That is, even when the door 1020 is in a closed state, the inside of the drum 1030 can be visually exposed via the transparent material. Therefore, a state of laundry accommodated inside the drum 1030 can be identified via the door 1020.

The drum 1030 is rotatably installed inside the cabinet 1010. The drum 1030 can be formed in a cylindrical shape so as to accommodate the laundry therein. The drum 1030 can be disposed lying down along a front and rear direction of the laundry treating apparatus 1000 so as to receive the laundry via the inlet 1011. In addition, an unevenness can be formed on an outer circumferential surface of the drum 1030 along the outer circumferential surface of the drum 1030.

In addition, the drum 1030 can include drum inlets that open toward the front and rear sides of the laundry treating apparatus 1000, respectively. The laundry can be introduced into the drum 1030 via the drum inlet on the front side. High-temperature dry air can be supplied into the drum 1030 via the drum inlet on the rear side.

The drum 1030 can be rotatably supported by a front supporter 1040, a rear supporter 1050, and a roller 1060. The front supporter 1040 can be disposed in front of the drum 1030, and the rear supporter 1050 can be disposed at the rear of the drum 1030.

The front supporter 1040 and the rear supporter 1050 can be connected to the cabinet 1010 by fastening of a connecting member 1013 or the like. For example, the cabinet 1010 can include pillars 1012 extending vertically at positions adjacent to both side corners of the front supporter 1040. A portion of the connecting member 1013 can be disposed facing the front supporter 1040, and another portion of the connecting member 1013 can be bent several times from the portion so as to surround the pillar 1012. When a screw is fastened through the connecting member 1013 and the front supporter 1040, the connecting member 1013 and the front supporter 1040 are connected to each other. Similarly, when the screw is fastened through the connecting member 1013 and the pillar 1012, the connecting member 1013 and the pillar 1012 can be connected to each other. The connecting member 1013 and the pillar 1012 can be connected to each other in other schemes other than the screw.

The rollers 1060 can be respectively installed on the front supporter 1040 and the rear supporter 1050. The roller 1060 can be disposed directly beneath the drum 1030 and can be in contact with the outer circumferential surface of the drum 1030. The roller 1060 can be rotatably formed, and a first elastic member such as rubber can be coupled to the outer circumferential surface of the roller 1060 so as to absorb vibration and impact during rotation. When the drum 1030 rotates, the roller 1060 will rotate in a direction opposite to a rotation direction of the drum 1030.

A heat pump module 1100 capable of adjusting a temperature and a humidity of air supplied to the drum 1030 can be installed below the drum 1030. Herein, the term 'below the drum 1030' refers to a space between the outer circumferential surface of the drum 1030 and the base 1310. The heat pump module 1100 refers to an apparatus that makes air dry and heated via heat exchange between a refrigerant and air. When the heat pump module 1100 is operated, air is dehumidified and heated via sequential heat exchange with an evaporator 1110 and a condenser 1130.

An exhaust duct 1210 and an intake duct 1220 form flow channels for circulating the high-temperature dry air formed by the heat pump module 1100 to the drum 1030. The exhaust duct 1210 is disposed at the rear of the drum 1030, and the air heated and dried by the heat pump module 1100 is supplied to the drum 1030 via the exhaust duct 1210. The intake duct 1220 is disposed in front of and below the drum 1030. When the air absorbs moisture from the laundry being treated inside the drum, the air can be recovered via the intake duct 1220 again.

A filter 1070 can be disposed between the front supporter 1040 and the intake duct 1220. An upper portion of the filter 1070 is mounted on a filter mounting portion disposed on the front supporter 1040, and a lower portion of the filter 1070 is inserted into the intake duct 1220. Dust or lint generated while the high-temperature dry air dries the laundry can be filtered by the filter 1070.

The intake duct 1220 and the exhaust duct 1210 can be connected to each other by a connecting duct 1230. A circulation fan cover 1330 can also be located between the intake duct 1220 and the exhaust duct 1210.

An inlet of the connecting duct 1230 can be connected to the intake duct 1220. An evaporator (or a first heat exchanger) 1110 and a condenser (or a second heat exchanger) 1130 corresponding to heat exchangers of the heat pump module 1100 can be included inside the connecting duct 1230. In addition, an outlet of the connecting duct 1230 can be connected to the circulation fan cover 1330. That is, the inlet of the circulation fan cover 1330 is connected to the outlet of the connecting duct 1230. The circulation fan cover 1330 can accommodate a circulation fan 1710 therein. An outlet of the circulation fan cover 1330 can be connected to an exhaust duct 1210.

The base 1310 can be positioned beneath the heat pump module 1100. As described above, the base 1310 can form the floor surface of the cabinet and provide the space for supporting or installing various components of the laundry treating apparatus 1000, including the heat pump module 1100.

A connection cover 1320 is installed between the base 1310 and the drum 1030. The connection cover 1320 is formed to cover the heat pump module 1100 mounted on the base 1310. When a sidewall of the base 1310 and the connection cover 1320 are coupled to each other, an air circulation flow channel can be formed. That is, a portion of the heat pump module 1100 can be installed in the air circulation flow channel.

In other words, a portion of the connecting duct can be integrally formed with the base, and the connecting duct 1230 can be formed when the connection cover 1320 is coupled to the base 1310.

A water tank 1410 is disposed on an upper left or upper right side of the drum 1030. Herein, the term 'upper left or upper right side of the drum 1030' refers to an upper left side or an upper right side of a space between the outer circumferential surface of the drum 1030 and an inner circumferential surface of the cabinet 1010. It is shown in FIG. 1 that the water tank 1410 is disposed on the upper left side of the drum 1030. Condensed water can be collected in the water tank 1410.

When the air that has dried the laundry is recovered via the intake duct 1220 and exchanges heat with the evaporator 1110, the condensate water will be generated. More specifically, when a temperature of the air is lowered by the heat exchange between the refrigerant and the circulated air in the evaporator 1110, an amount of saturated water vapor that the air can contain is reduced. Therefore, because the air recovered via the intake duct 1220 contains the moisture of an amount exceeding the amount of saturated water vapor, the condensed water will be generated by the heat exchange with the evaporator 1110.

A water supply pump 1440 (see FIG. 3) is installed inside the laundry treating apparatus 1000. The water supply pump 1440 can pump the condensed water up to a water tank 1410.

A tank cover 1420 can be disposed at one corner of the front surface of the laundry treating apparatus 1000 so as to correspond to a location of the water tank 1410. The tank cover 1420 can be formed to be gripped by a hand and can be disposed on the front surface of the laundry treating apparatus 1000. When the tank cover 1420 is pulled to empty the condensed water collected in the water tank 1410, the water tank 1410 can be withdrawn from the water tank support frame 1430 together with the tank cover 1420.

A water tank support frame 1430 can support the water tank 1410 inside the cabinet 1010. The water tank support frame 1430 can extend along an insertion or withdrawal direction of the water tank 1410 so as to guide insertion or withdrawal of the water tank 1410.

A control panel 1500 can be disposed next to the tank cover 1420. The control panel 1500 can include input device 1510 for receiving selection of a laundry treatment course from a user, and output device 1520 for visually displaying an operating state of the laundry treating apparatus 1000. The input device 1510 can be formed as a jog-dial, but may not be necessarily limited thereto. The output device 1520 can be formed to visually display the operating state of the laundry treating apparatus 1000, and the laundry treating apparatus 1000 can have a separate component for an auditory indication in addition to the visual display.

A controller 1600 can control operation of the laundry treating apparatus 1000 based on a user's input applied via the input device 1510. The controller 1600 can be composed of a printed circuit board (PCB) and elements mounted on the printed circuit board. When the user selects the laundry treatment course via the input device 1510 and inputs a control command such as the operation of the laundry treating apparatus 1000, the controller 1600 can control the operation of the laundry treating apparatus 1000 based on preset algorithms.

The printed circuit board and the elements mounted on the printed circuit board constituting the controller 1600 can be disposed on the upper left side or upper right side of the drum 1030. However, they can be located anywhere as long as the operation of the laundry treating apparatus 1000 can be controlled.

In FIG. 1, for example, the controller 1600 is disposed above the drum 1030 on an opposite side of the water tank 1410, that is, on the upper right side of the drum 1030. Considering that the condensed water is collected in the water tank 1410, that the air containing the moisture flows through the heat pump module 1100, the intake duct 1220, the connecting duct 1230, and the exhaust duct 1210, and that electrical products such as the printed circuit board and the elements are vulnerable to water, the controller 1600 can be spaced apart from the water tank 1410 or the heat pump module 1100 as much as possible.

A heat dissipation fan 1730 can be mounted adjacent to the printed circuit board. For example, the heat dissipation fan 1730 can be installed at an upper end of the printed circuit board. In addition, the heat dissipation fan 1730 can be installed to face a cooling fin of the printed circuit board.

The heat dissipation fan 1730 generates wind to cool the printed circuit board or the cooling fin mounted on the printed circuit board. The heat dissipation fan 1730 can generate the wind in a downward direction of the laundry treating apparatus 1000. The heat dissipation fan 1730 can be constructed as an axial flow fan that generates wind in a direction of a rotation shaft. Circulation flow can be formed in an annular space between the cabinet 1010 and the drum 1030 by the heat dissipation fan 1730.

An inner space of the cabinet 1010 can be divided into a first space I and a second space II based on the drum 1030. The first space I is a cylindrical space surrounded by the drum 1030 and corresponds to the space for accommodating the laundry therein. The second space II is an annular space between the cabinet 1010 and the drum 1030, and corresponds to a space in which the electric parts and appliance structures of the laundry treating apparatus 1000 are installed. The space between the cabinet 1010 and the drum 1030 refers to the second space II.

When the cylindrical drum 1030 is installed inside the cabinet 1010, which has a shape close to a hexahedron as a whole, regions between the cabinet 1010 and the drum 1030 where the electric parts or the appliance structures can be installed can be referred to as four corners formed outwardly of the drum 1030 when the laundry treating apparatus 1000 is viewed from the front.

The evaporator 1110 and the condenser 1130 corresponding to the heat exchangers, and the connecting duct 1230 for surrounding the heat exchanger can be installed below the drum 1030 eccentrically to one side and can be located at one of the four corners. A compressor 1120, a motor 1800, a blowing fan 1820, and the like can be installed below the drum 1030 eccentrically to the other side and can be located at another one of the four corners. The printed circuit board constituting the controller 1600 can be installed above the drum 1030 eccentrically to one side and can occupy still another one of the four corners. The water tank 1410 can be installed above the drum 1030 eccentrically to the other side and can occupy the last one of the four corners.

Because of such arrangement, the blowing fan 1820, the connecting duct 1230, the printed circuit board constituting the controller 1600, and the water tank 1410 may not overlap each other in the front and rear direction of the laundry treating apparatus 1000. In addition, because of such arrangement, a size of the drum 1030 can be maximized within the limited interior of the cabinet 1010 by efficiently utilizing the inner space of the laundry treating apparatus 1000. Thus, efficient use of space will be possible.

For example, a cross-sectional area of the drum 1030, which can be calculated as an area of a circle, can be in a range from 330,000 $mm^2$ to 360,000 $mm^2$.

Figure 2:
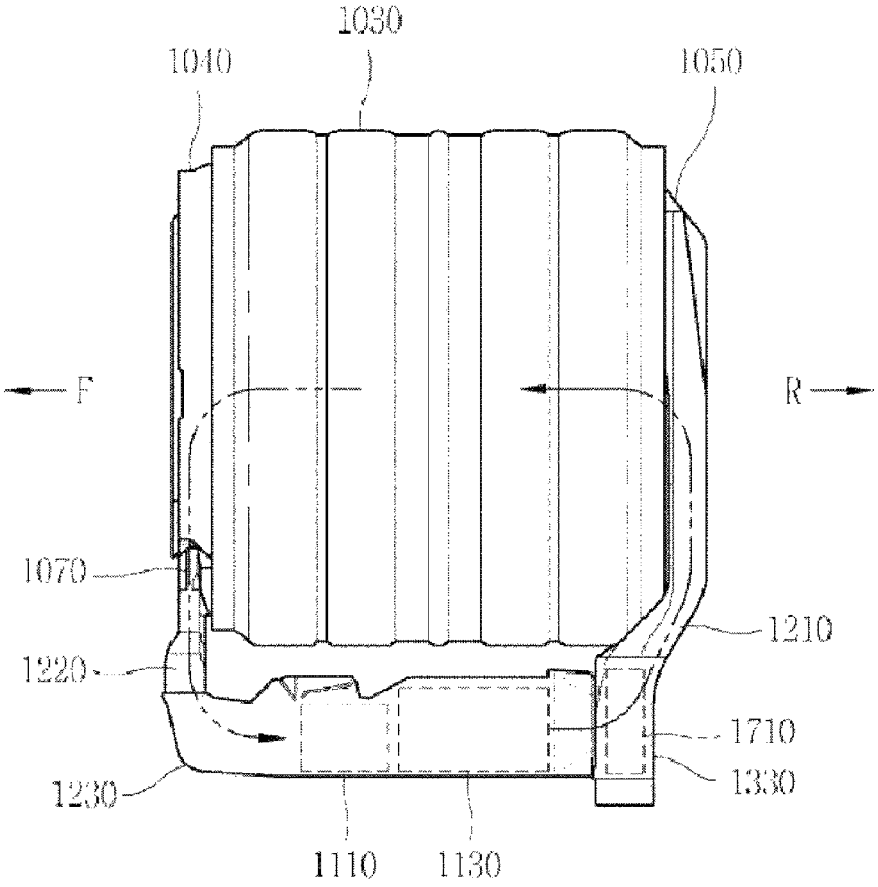
FIG. 2 schematically shows an example of a drum and a duct for circulating air inside the drum.

FIG. 2 schematically shows side surfaces of the drum 1030 and the air circulation flow channel. In FIG. 2, a left side corresponds to the front side F of the drum 1030, and a right side corresponds to the rear side R of the drum 1030.

In order to dry the laundry put into the drum 1030, the process of supplying the high-temperature dry air into the drum 1030, recovering the air that has dried the laundry, and removing the moisture from the air may be repeated.

Unlike the exhaust-type dryer, air may continuously circulate through the drum 1030 to repeat such process in the condensation-type dryer. The circulation of the air is performed via the drum 1030 and the air circulation flow channel.

The air circulation flow channel is formed by the exhaust duct 1210, the intake duct 1220, and the connecting duct 1230 and the circulation fan cover 1330 disposed between the exhaust duct 1210 and the intake duct 1220. Each of the exhaust duct 1210, the intake duct 1220, the connecting duct 1230, and the circulation fan cover 1330 can be formed by coupling of a plurality of members.

Based on the air flow, the exhaust duct 1210, the drum 1030, the intake duct 1220, the connecting duct 1230, and the circulation fan cover 1330 are sequentially connected, and the circulation fan cover 1330 is again connected to the exhaust duct 1210 to form a closed flow channel.

The exhaust duct 1210 extends from the connecting duct 1230 to a rear surface of the rear supporter 1050. The rear surface of the rear supporter 1050 refers to a surface directed in the rearward direction of the laundry treating apparatus 1000. Because the drum 1030 and the connecting duct 1230 are spaced apart from each other along the vertical direction, the exhaust duct 1210 can have a structure extending vertically from the connecting duct 1230 disposed beneath the drum 1030 toward a rear surface of the drum 1030.

The exhaust duct 1210 can be coupled to the rear surface of the rear supporter 1050. A hole can be defined in the rear surface of the rear supporter 1050, so that the high-temperature dry air can be supplied from the exhaust duct 1210 into the drum 1030 through the hole defined in the rear supporter 1050.

The intake duct 1220 is disposed below the front supporter 1040. Because the front inlet for putting the laundry into the drum 1030 should be defined at the front side of the drum 1030, the intake duct 1220 can be disposed below the front side of the drum 1030.

The intake duct 1220 can extend from the front supporter 1040 to the connecting duct 1230. The intake duct 1220 can also extend vertically like the exhaust duct 1210, but a length of the vertical extension of the intake duct 1220 is smaller than that of the exhaust duct 1210. The air that has dried the laundry in the drum 1030 can be recovered to the connecting duct 1230 via the intake duct 1220.

The evaporator (or the first heat exchanger) 1110 and the condenser (or the second heat exchanger) 1130 corresponding to the heat exchangers of the heat pump module 1100 can be included inside the connecting duct 1230. In addition, the circulation fan 1710 for supplying the high-temperature dry air to the exhaust duct 1210 is also installed inside the connecting duct 1230. Based on the flow of air, the evaporator 1110 can be disposed upstream of the condenser 1130, and the circulation fan 1710 can be disposed downstream of the condenser 1130.

The circulation fan 1710 can generate a flow in a direction in which the air is suctioned from the condenser 1130 and supplied to the exhaust duct 1210. The circulation fan 1710 can be installed inside the circulation fan cover 1330. That is, the inlet of the circulation fan cover 1330 can be connected to the connecting duct 1230, and the outlet thereof can be connected to the inlet of the exhaust duct 1210.

The reason why the circulation fan 1710 is located after the evaporator 1110 and the condenser 1130 is to form a negative pressure inside the connecting duct 1230 to make the flow more uniform than when the circulation fan 1710 is located between the intake duct 1220 and the evaporator 1110.

FIG. 3 shows the base 1310 and components mounted on the base 1310. In FIG. 3, as in FIG. 1, F indicates the front side of the laundry treating apparatus 1000, and R indicates the rear side of the laundry treating apparatus 1000.

Referring to FIG. 3, the base 1310 can provide a space for supporting and installing the mechanical parts of the laundry treating apparatus 1000, including the heat pump module 1100. For the mounting of the mechanical parts, the base 1310 can include multiple mounting portions 1311. The multiple mounting portions 1311 refer to regions prepared for the mounting of the mechanical parts. The mounting portions 1311 can be partitioned from each other by a step of the base 1310.

Unlike the drum 1030 being disposed at a center of the laundry treating apparatus 1000 in a left and right direction, the air circulation flow channel can be disposed to be biased to a left or right side of the drum 1030. That is, an example in which the air circulation flow channel is disposed closer to the right surface of the cabinet 1010 than to the left surface of the cabinet 1010 is shown. In other words, FIG. 3 shows an example in which the air circulation flow channel is disposed on a lower right side of the drum 1030. The eccentric arrangement of the air circulation flow channel is for efficient drying of the laundry and efficient arrangement of the parts.

An inlet 1231 of the connecting duct 1230 is disposed beneath the intake duct 1220 and connected to the intake duct 1220. The inlet 1231 of the connecting duct 1230 can guide the air along with the intake duct 1220 in a direction inclined toward a lower left or lower right side. For example, the inlet 1231 can become narrower in the downward direction. In particular, a left side surface of the inlet 1231 can extend in a direction inclined toward the lower right side. When the air circulation flow channel is disposed on the lower left side of the drum 1030, a right side surface of the inlet 1231 will be inclined to the lower left side.

Based on the flow of air, the evaporator 1110, the condenser 1130, and the circulation fan 1710 can be sequentially disposed downstream of the inlet 1231. When the laundry treating apparatus 1000 is viewed from the front, the condenser 1130 will be disposed at the rear of the evaporator 1110 and the circulation fan 1710 will be disposed at the rear of the condenser 1130. The evaporator 1110, the condenser 1130, and the circulation fan 1710 can be installed on respective mounting portions of the base 1310.

The connection cover 1320 can be installed on the evaporator 1110 and the condenser 1130. The connection cover 1320 can be composed of a single member or multiple members. When the connection cover 1320 is formed of the multiple members, the connection cover 1320 can include a front connection cover 1321 and a rear connection cover 1322.

The connection cover 1320 is formed to cover the evaporator 1110 and the condenser 1130. That is, the connecting duct includes the evaporator 1110 and the condenser 1130. A sidewall and a bottom surface of the connecting duct can be formed by the step or the sidewall of the base 1310, and atop surface of the connecting duct 1230 can be formed by the connection cover 1320.

The circulation fan 1710 can be covered by the base 1310 and the circulation fan cover 1330. An outlet 1331 of the circulation fan cover 1330 is formed above the circulation fan 1710. The outlet 1331 is connected to the exhaust duct 1210. The high-temperature dry air generated by the heat pump module 1100 will be supplied to the drum 1030 via the exhaust duct 1210.

The water supply pump 1440 is installed on one side of the condenser 1130 (or one side of the circulation fan 1710). The water supply pump 1440 can allow the condensed water collected in a mounting portion where the water supply pump 1440 is installed to flow.

The base 1310 can be formed to drain the condensed water generated during the operation of the heat pump module 1100 to the mounting portion where the water supply pump 1440 is installed. For example, a bottom surface of the mounting portion can be inclined or a vertical level of the mounting portion where the water supply pump 1440 is installed can be partially low to allow the condensed water to flow to the mounting portion where the water supply pump 1440 is installed.

Because of the structure of the base 1310, the condensed water collected in the mounting portion where the water supply pump 1440 is installed can be transferred to the water tank 1410 by the water supply pump 1440. In addition, the condensed water can be transferred by the water supply pump 1440 and used for cleaning the evaporator 1110 or the condenser 1130.

The compressor 1120 and a box fan 1720 for cooling the compressor 1120 can be installed on one side of the water supply pump 1440. The compressor 1120 is one element constituting the heat pump module 1100, but does not perform direct heat exchange with air, so that the compressor 1120 does not need to be installed in the air circulation flow channel. Rather, when the compressor 1120 is installed inside the air circulation flow channel, it can interfere with the flow of air, so that the compressor 1120 can be installed outside the air circulation flow channel, that is, outside the connecting duct 1230 as shown in FIG. 3.

The box fan 1720 generates wind toward the compressor 1120 or in a direction in which the air is suctioned from the compressor 1120. When a temperature of the compressor 1120 is lowered by the box fan 1720, a compression efficiency will be improved. The box fan 1720 can be controlled by the controller 1600 to operate only when a refrigerant discharge temperature of the compressor rises to a temperature equal to or higher than a preset reference temperature.

Based on a flow of the refrigerant, the accumulator 1140 is installed upstream of the compressor 1120 before the refrigerant enters the compressor. The accumulator 1140 can be disposed to separate a two-phase refrigerant flowing into the compressor 1120 into a gas refrigerant and a liquid refrigerant and allow only the gas refrigerant flows into the compressor 1120. This is because when the liquid refrigerant flows into the compressor 1120, it can cause a failure of the compressor 1120 and a decrease in the efficiency.

The refrigerant evaporates (the liquid phase→the gas phase) while absorbing heat in the evaporator 1110, and is suctioned into the compressor 1120 in a low-temperature and low-pressure gas state. When the accumulator 1140 is installed upstream of the compressor 1120, the refrigerant can pass through the accumulator 1140 before being introduced into the compressor 1120. In the compressor 1120, the gas refrigerant is compressed and becomes a high-temperature and high-pressure state, and flows to the condenser 1130. In the condenser 1130, the refrigerant is liquefied while releasing heat. The liquefied high-pressure refrigerant is depressurized in an expander. The low-temperature low-pressure liquid refrigerant enters the evaporator 1110. The expander can be a capillary tube or an expansion valve.

The high-temperature dry air can be supplied to the drum 1030 via the exhaust duct 1210 to dry the laundry. The high-temperature dry air evaporates the moisture of the laundry and becomes high-temperature high-humidity air.

The high-temperature high-humidity air is recovered via the intake duct 1220 and receives heat from the refrigerant via the evaporator 1110 to become low-temperature air. As the temperature of the air decreases, the amount of saturated water vapor of the air decreases, and the vapor contained in the air is condensed to become water, which is liquid. Then, the low-temperature dry air can receive the heat of the refrigerant via the condenser 1130, can become high-temperature dry air, and can be supplied to the drum 1030 again.

In some implementations, the motor 1800 can be installed in front of the compressor 1120. The motor 1800 can include a rotor rotated by a stator disposed inside the motor 1800. In addition, the motor 1800 can include a rotation shaft 1801 (see FIG. 4) that is coupled to the rotor and transmits a rotational force resulted from the rotation of the rotor to the outside. In general, the rotation shaft 1801 can protrude to one side, but an extending rotation shaft 1802 (see FIG. 4) extending to the other side can be further included such that the rotation shaft 1801 protrudes to both sides. However, because the extending rotation shaft 1802 is a portion of the rotation shaft 1801, the rotation shaft 1801 and the extending rotation shaft 1802 will rotate in the same direction and at the same speed.

The rotation shaft 1801 and the extending rotation shaft 1802 can be exposed in opposite directions. That is, the rotation shaft 1801 can be disposed to be directed in the rearward direction of the laundry treating apparatus 1000, and the extending rotation shaft 1802 can be disposed to be directed in a forward direction of the laundry treating apparatus 1000.

A rotating portion 1810 can be connected to the rotation shaft 1801 so as to transmit the rotational force of the motor 1800 to the drum 1030. In addition, in order to reduce a rotational speed of the motor 1800, the rotation shaft 1801 may not be directly connected to the drum. In some examples, the rotating portion 1810 can include a dual pulley 1815.

A drum belt 1860 (see FIG. 4) can be coupled to the dual pulley 1815, and a driving force of the motor 1800 can be transmitted to the drum 1030 via the drum belt 1860. The drum 1030 is rotated by the driving force of the motor 1800 transmitted via the dual pulley 1815 and the drum belt. The rotational speed of the drum 1030 can be adjusted by the dual pulley 1815. Because the drum belt 1860 is not directly connected to the rotation shaft 1801, the rotational speed of the drum 1030 does not necessarily coincide with a rotational speed of the rotation shaft 1801. This is because the dual pulley 1815 has two pulleys with different diameters and is able to reduce the rotational speed of the rotation shaft. This has been described above in FIG. 4.

The blowing fan 1820 is installed on the extending rotation shaft 1802. The blowing fan 1820 can be constructed as the axial flow fan that generates the wind in the forward direction of the laundry treating apparatus 1000.

The blowing fan 1820 generates the wind in a direction in which the air is suctioned from the motor 1800. The direction in which the air is suctioned from the motor 1800 indicates a direction from the rotation shaft 1801 toward the extending rotation shaft 1802. Therefore, the motor 1800 can be cooled by the blowing fan 1820. Because the blowing fan 1820 is directly connected to the extending rotation shaft 1802, a rotational speed of the blowing fan 1820 coincides with the rotational speed of the extending rotation shaft 1802.

When, as the refrigerant, a flammable refrigerant, such as R-290, is used, the blowing fan 1820 can be used as one of safety devices in preparation for a case in which the flammable refrigerant leaks. That is, considering a density of the flammable refrigerant, a place where the flammable refrigerant can gather in the case in which the flammable refrigerant leaks will be near the compressor 1120 or the motor 1800. In particular, because the base is partially recessed, the flammable refrigerant can be more easily collected in a motor mounting portion 1313. When the flammable refrigerant leaks, in order to prevent explosion, the leaked flammable refrigerant may be diluted with air to have a concentration equal to or lower than a concentration at which the flammable refrigerant can ignite. The blowing fan 1820 can be utilized as one of the stabilizers in charge of the same. That is, the flammable refrigerant collected in the motor mounting portion 1313 can be rapidly diluted by the flow of air by the blowing fan 1820.

The blowing fan 1820 includes a hub 1821 and a plurality of impellers 1822. The hub 1821 can be directly connected to the extending rotation shaft 1802. The plurality of impellers 1822 can protrude from an outer circumferential surface of the hub 1821. The plurality of impellers 1822 can have the same shape and can be disposed inclined with respect to the extending rotation shaft 1802 so as to generate the wind in the direction in which air is suctioned.

The number of plurality of impellers 1822 is an odd number. This is because the number of plurality of impellers 1822 can affect vibration generated in the blowing fan 1820. When the number of plurality of impellers 1822 is an even number, the vibration can increase due to a resonance phenomenon. On the other hand, when the number of plurality of impellers 1822 is the odd number, the vibration can be reduced compared to the case in which the number of plurality of impellers 1822 is the even number.

Although sealing of the drum 1030 may not be perfect, when the blowing fan 1820 rotates, generation of condensation due to the incomplete sealing of the drum 1030 can be suppressed. For example, it is difficult to completely exclude the high-temperature high-humidity air from being discharged into a space between an inner circumferential surface of the drum 1030 and the inner circumferential surface of the cabinet 1010. In particular, this is because the condensation is caused when the air leaked from the drum 1030 is stagnant.

However, because the blowing fan 1820 causes convection, congestion of the air leaked from the drum 1030 is suppressed and the generation of the condensation is suppressed. The air leaked from the drum 1030 is exhausted while continuously flowing by the blowing fan 1820. For this reason, even when using the flammable refrigerant as described above, the blowing fan 1820 can be used to dilute the leaked flammable refrigerant or discharge the same to the outside.

When the motor 1800 has two rotation shafts, many advantages can be obtained in terms of reducing power consumption of the laundry treating apparatus 1000. Basically, compared to a case in which a motor for rotating the drum 1030 and a motor for rotating the blowing fan 1820 are respectively disposed, the power consumption is reduced by half.

In particular, a time point at which the blowing fan 1820 rotates is the same as a time point at which the drum 1030 rotates. This is because the high-temperature dry air can be supplied to the drum 1030 and the high-temperature high-humidity air can leak from the drum 1030 while the drum 1030 rotates. Therefore, a situation in which the power is consumed for the rotation of the blowing fan 1820 while the drum 1030 does not rotate may not occur.

The motor 1800 and the blowing fan 1820 can be installed in the second space II. Also in the second space II, the motor 1800 and the blowing fan 1820 can be installed outside the connecting duct 1230. The term 'outside the connecting duct 1230' refers to the space between the cabinet 1010 and the connecting duct 1230. The space between the cabinet 1010 and the drum 1030 can be divided into an inside and an outside of the connecting duct 1230. The air supplied to the drum 1030 or discharged from the drum 1030 will flow into the connecting duct 1230.

The blowing fan 1820 should be distinguished from a structure of cooling the motor 1800 by suctioning outside air via the front surface of the cabinet 1010 considering the wind direction thereof. First, when it is to cool the motor 1800 by suctioning outside air, a hole may be defined in the front surface of the cabinet 1010, and the wind may be generated in a direction of suctioning the outside air via the hole.

However, the blowing fan 1820 disclosed in FIG. 3 is for suppressing the condensation occurring in the space between the cabinet 1010 and the drum 1030 rather than for cooling the motor 1800. Therefore, the front of the blowing fan 1820 should be blocked by the front surface of the cabinet 1010 disposed away from the blowing fan 1820. When the hole is defined in the front surface of the cabinet 1010, because the wind generated by the blowing fan 1820 escapes to the outside of the cabinet 1010 via the hole, the effect of preventing the condensation via the convection can be reduced.

Figure 4:
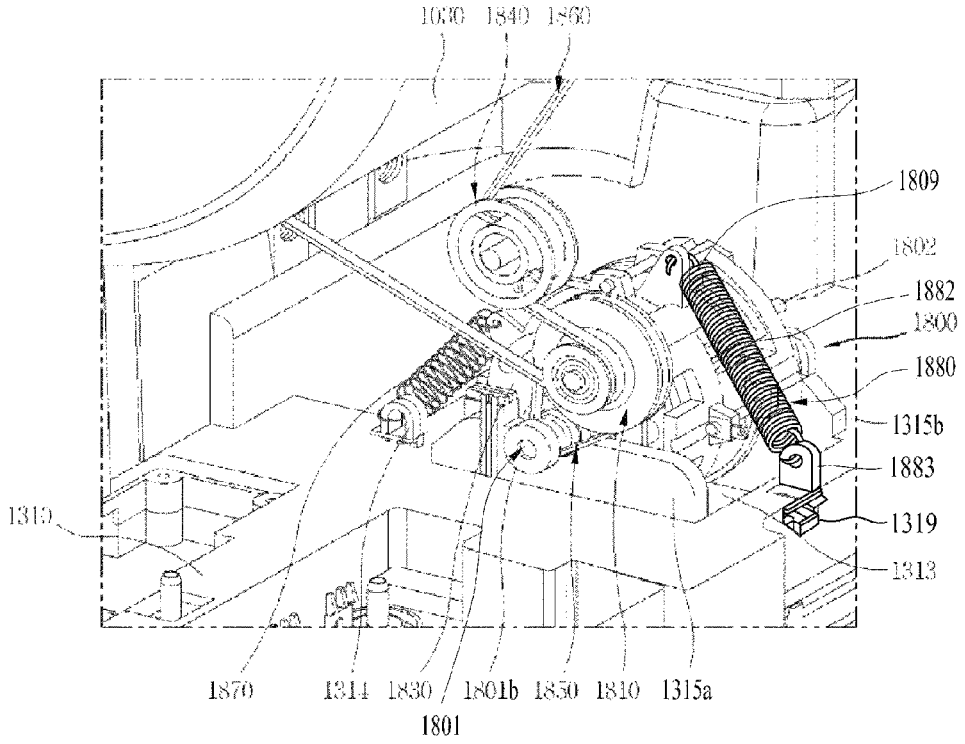
FIG. 4 is a front-side view of an example of a motor, a rotating portion, a tensile portion, a first elastic member, and a second elastic member.

FIG. 4 is a rear-side view of an example of the motor 1800 mounted. Referring to FIG. 4, the motor mounting portion 1313 can be defined in the base 1310. The motor mounting portion 1313 can form a bottom surface lower than a peripheral region in the base 1310 for mounting the motor 1800 thereon. The motor 1800 can be disposed in the motor mounting portion 1313 such that the rotation shaft 1801 faces the rear side R of the laundry treating apparatus 1000 and the extending rotation shaft 1802 faces the front side F of the laundry treating apparatus 1000. However, the motor 1800 may not be in contact with the bottom surface of the motor mounting portion 1313, and can be supported by a motor support 1315 in a state of being spaced apart state from the bottom surface of the motor mounting portion 1313.

The motor support 1315 can protrude upward from the motor mounting portion 1313. A rotation shaft support 1803 for rotatably supporting the rotation shaft 1801 and the extending rotation shaft 1802 is formed in the motor 1800. The rotation shaft support 1803 includes a plurality of rotation shaft supports, and one of those surrounds the rotation shaft 1801 and the other surrounds the extending rotation shaft 1802. Each motor support 1315 surrounds the rotation shaft support 1803 so as to tiltably support the rotation shaft 1801 and the extending rotation shaft 1802.

In some implementations, the motor support 1315, as shown in FIG. 4, can include a front motor support 1315*a* protruding at a front portion of the motor mounting portion and a rear motor support 1316*b*. The motor supports 1315*a* and 1315*b* can support the rotation shaft 1801 and the extending rotation shaft 1802, respectively.

In order for the motor support 1315 to tiltably support the rotation shaft support 1803, an outer circumferential surface of the rotation shaft support 1803 should have a convex curved surface, and the motor support 1315 can have a concave curved surface corresponding to the rotation shaft support 1803.

At both ends of the rotation shaft support 1803, ribs 1803*a* are formed to limit a movement in the front and rear direction of the motor 1800. The rib 1803*a* can protrude along an outer circumferential surface of the rotation shaft support 1803. When the rotation shaft support 1803 is seated on the motor support 1315, because the rib 1803*a* is caught on an outer surface of the motor support 1315, the movement in the front and rear direction of the motor 1800 can be restricted.

The motor 1800 can include the conventional stator and rotor, and the rotation shaft 1801 coupled to the rotor and rotating together with the rotor. The rotating portion 1810 rotating by the rotational force generated by the motor 1800 can be coupled to the rotation shaft 1801.

The rotating portion 1810 can include a motor housing 1804 coupled to an outer circumferential surface of the motor 1800, a support shaft 1806 (see FIG. 7) disposed in parallel with the rotation shaft 1801 and coupled to the motor housing 1804, a motor pulley 1801*b* coupled to the rotation shaft 1801 and rotating together with the rotation shaft 1801, a first pulley 1811 that rotates by being coupled to the support shaft 1806, a pulley belt 1850 that connects the motor pulley 1801*b* and the first pulley 1811 to each other so as to transmit a rotational force of the motor pulley 1801*b* to the first pulley 1811, and a second pulley 1812 coupled to the support shaft 1806 and rotating together with the first pulley 1811.

The motor housing 1804 refers to a body portion of the motor 1800 that is covered by a casing or a housing of the motor 1800. The motor housing 1804 can have a cylindrical shape corresponding to the motor 1800 as a whole, but the cylindrical shape may not refer to a mathematically precise shape. The motor housing 1804 can be constructed to protect the motor 1800 by surrounding the outer circumferential surface of the motor 1800 or to provide a connection space for a member for connecting the motor 1800 to the base 1310.

The rotation shaft 1801 and the extending rotation shaft 1802 protrude from the motor housing 1804 in opposite directions. In order to tilt only the motor housing in a state in which positions of the rotation shaft 1801 and the extending rotation shaft 1802 are fixed, when viewing the motor 1800 from the front and rear of the laundry treating apparatus 1000, the rotation shaft 1801 and the extending rotation shaft 1802 can protrude from a center of the motor housing, respectively. That is, the rotation shaft 1801 and the extending rotation shaft 1802 can be formed as a central shaft rotating by being coupled to the rotor of the motor protrudes in the forward and rearward directions.

The motor housing 1804 can include the support shaft 1806 protruding so as to rotatably support the dual pulley 1815. The support shaft 1806 can be disposed in parallel with the rotation shaft 1801. Because the rotation shaft 1801 protrudes in the rearward direction of the laundry treating apparatus 1000, the support shaft 1806 will also in the rearward direction of the laundry treating apparatus 1000.

Figure 6:
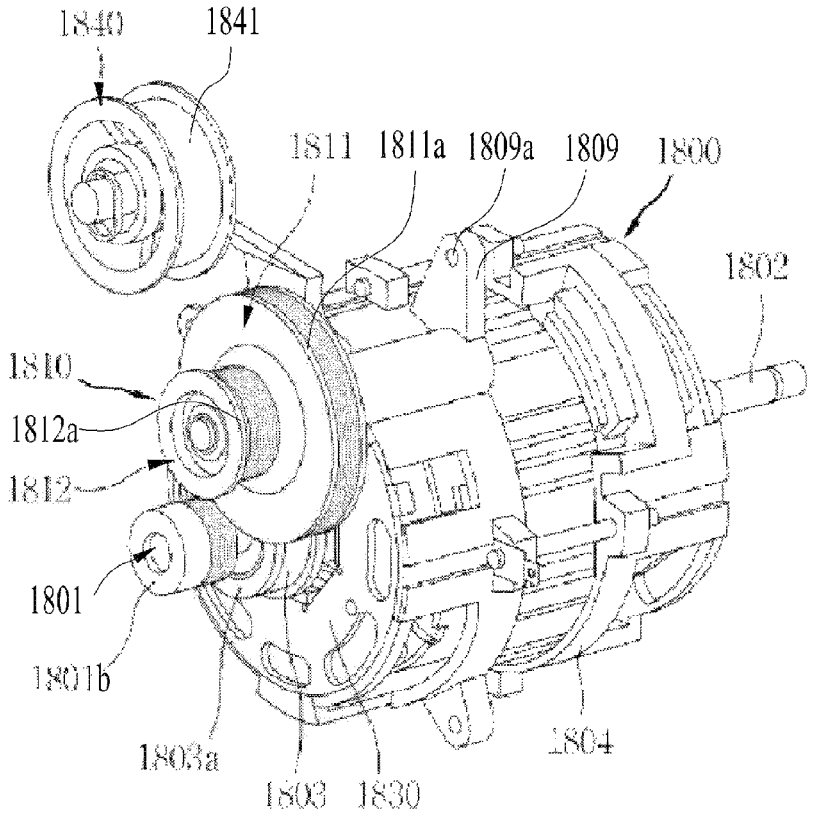
FIG. 6 shows an example in which the motor, the rotating portion, the tensile portion, and the bracket are mutually coupled to each other.

When the rotation shaft 1801 protrudes from a center in a side portion of the motor housing seen when looking at the motor 1800 from the rear of the laundry treating apparatus 1000, the support shaft 1806 can protrude at a position eccentric from the center of the side portion of the motor housing. FIG. 6 shows an example in which the support shaft 1806 protrudes from an edge of the side portion.

A tensile portion 1840 can be disposed to increase a contact angle between the drum 1030 and the drum belt 1860. The tensile portion 1840 can include an idler pulley 1841 (see FIG. 5) having a pulley shape. The idler pulley

1841 can be disposed to press a tight side 1861 (see (c) in FIG. 9) to a slack side 1862 (see (c) in FIG. 9) of the drum belt 1860. When a diameter difference between the outer circumferential surface of the drum 1030 and the second pulley 1812 is large, because the slip easily occurs as a contact angle between the second pulley 1812 and the drum belt 1860 is small. In order to prevent this, the idler pulley 1841 is used.

In general, in terms of a tension of the drum belt 1860, a portion of the drum belt 1860 that is tight based on the second pulley 1812 when the belt rotates is referred to as the tight side, and another portion of the drum belt 1860 that is relatively loose is referred to as the slack side. In addition, tensions applied to respective sides are referred to as a tight side tension and a slack side tension, respectively. In addition, a difference between such tight side tension and slack side tension is referred to as an effective tension. As the effective tension increases, transmitted power transmitted via the drum belt 1860 can increase. The effective tension increases as a friction coefficient of the drum belt 1860 and the contact angle between the drum belt 1860 and the second pulley 1812 increase.

The drum belt 1860 can include a cord, a rubber unevenness, a fabric, and an adhesive cushion. The cord is formed to be stretchable and contractible in a longitudinal direction. The rubber unevenness can be made of a rubber material and can be disposed on one surface of the cord to cause friction with an unevenness of the dual pulley 1815. The rubber unevenness is a portion in contact with the outer circumferential surface of the drum 1030, and the occurrence of the slip phenomenon between the drum 1030 and the drum belt 1860 can be suppressed by a material and a shape of the rubber unevenness.

The fabric is disposed on the other surface of the cord to cause contraction of the drum belt 1860 and maintain the tension. The adhesive cushion can be applied to each of both surfaces of the cord and can be used to adhere the rubber unevenness and the fabric to the cord. The adhesive cushion has not only adhesive properties, but also cushioning properties.

In order to maintain an ability of the drum belt 1860 to transmit the tension to the drum 1030, a length, a thickness, and a width of the drum belt 1860 may be precisely designed. In some implementations, when a size of a circular cross-sectional area of the drum is in a range from 330,000 $mm^2$ to 360,000 $mm^2$, in order to transmit the tension to the drum 1030, the length of the drum belt 1860 can be set to be in a range from 2,300 mm to 2,400 mm, the thickness of the drum belt 1860 can be set to be in a range from 2 mm to 3 mm, and the width of the drum belt 1860 can be set to be in a range from 6 mm to 7 mm.

The pulley belt 1850 can have the same configuration and can be made of the same material as the drum belt 1860, and can be different from the drum belt 1860 only in length. The pulley belt 1850 can be disposed to connect the motor pulley 1801*b* and the first pulley 1811 to each other. That is, the pulley belt 1850 will transfer a rotational force of the motor pulley 1801*b* to the first pulley 1811.

The idler pulley 1841 can adjust the tension transmitted to the drum 1030 via the drum belt 1860 by pressing the slack side 1862 in a direction closer to the tight side 1861.

A bracket 1830 (see FIG. 7) can be connected to the rotating portion 1810 to rotatably support the tensile portion 1840. The bracket 1830 can be coupled to the motor housing 1804, so that the rotating portion 1810 and the tensile portion 1840 can integrally rotate together. Specifically, when the motor rotates around the rotation shaft 1801, the motor can rotate in the first rotation direction by a predetermined rotation angle by the tension of the drum belt 1860 and a spring force of a first elastic member 1870 to be described later. In this regard, because the bracket 1830 and the motor housing 1804 are coupled to each other, the dual pulley 1815, the support shaft 1806, the idler pulley 1841, the bracket 1830, and the motor housing 1804 can integrally rotate by the rotation angle. In other words, it can be said that the tensile portion 1840 and the rotating portion 1810 rotate and tilt toward the drum 1030 when the motor 1800 rotates.

When the motor 1800 stops, the tensile portion 1840 and the rotating portion 1810 will return to their original positions before the rotation.

However, when the tensile portion 1840 and the rotating portion 1810 are rotated too much by the first elastic member 1870, a lot of tension is applied to the drum belt 1860 by the rotating portion 1810 and the tensile portion 1840, where a lot of energy can be consumed to drive the motor. Accordingly, the laundry treating apparatus 1000 can include a rotation preventing portion 1880 for preventing the first elastic member 1870 from rotating by an angle equal to or greater than the predetermined rotation angle.

Figure 5:
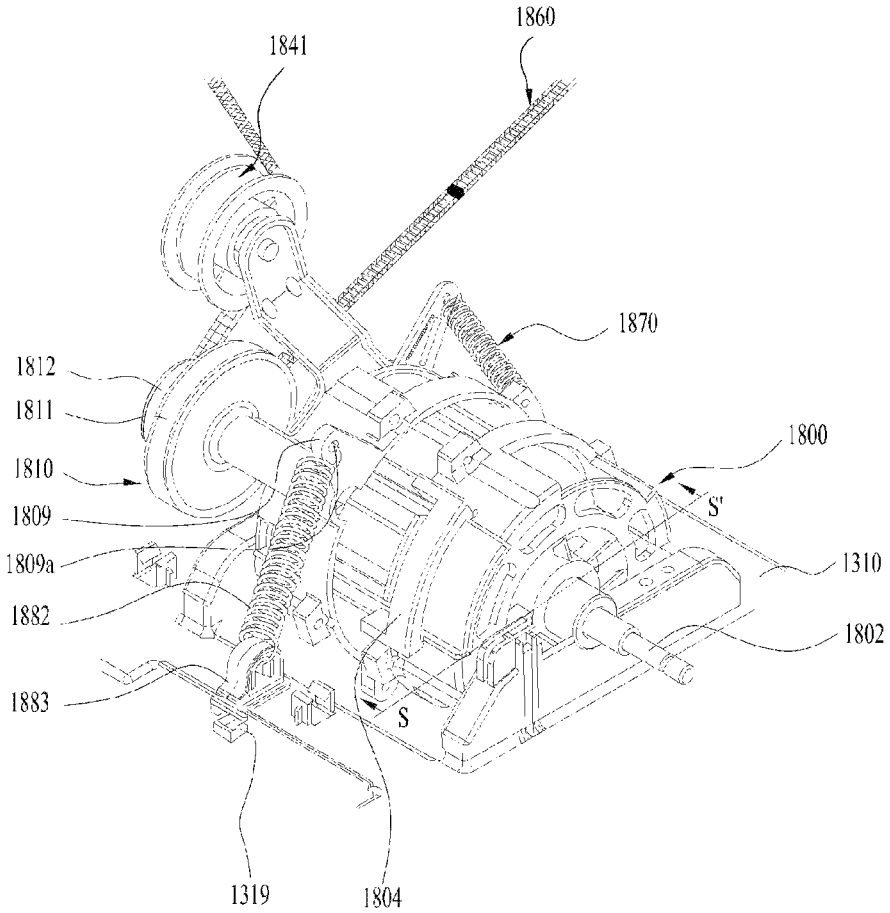
FIG. 5 is a rear-side view of the motor, the rotating portion, the tensile portion, the first elastic member, and the second elastic member.

The rotation preventing portion 1880 can be a second elastic member 1882 as shown in FIGS. 4 and 5, and can be a stopper directed in the same direction as the first elastic member 1870 and fixed to the base 1310 as shown in FIG. 12. As long as the rotating portion 1810 and the tensile portion 1840 can be prevented from rotating by the angle equal to or greater than the rotation angle, the rotation preventing portion 1880 can be formed in any shape.

The first elastic member 1870 can connect the bracket 1830 and the base 1310 to each other. Although FIG. 4 shows an example in which the first elastic member 1870 is connected to the bracket 1830, the first elastic member 1870 can be connected to the motor housing 1804 to be described later.

In particular, when the first elastic member 1870 is connected to the motor housing 1804, in order for efficient force application, the first elastic member 1870 and the second elastic member 1882 can be disposed at oppositely symmetrical positions in a front and rear longitudinal direction of the motor housing.

The first elastic member 1870 can have one end connected to the base 1310 and the other end connected to the bracket 1830 or the motor housing 1804 so as to integrally tilt the dual pulley 1815 and the idler pulley 1841. Accordingly, when the drum rotates, the rotating portion 1810 including the motor housing 1804 and the tensile portion 1840 can be integrally tilted by the first elastic member 1870.

A first fixing portion 1314 can be disposed on the base 1310 below the drum 1030. The first elastic member 1870 can be formed as a coil spring. A hook disposed at one end of the coil spring can be coupled to a first elastic member-coupled portion 1835 (first coupled portion), and a hook disposed at the other end can be coupled to the first fixing portion 1314. However, this corresponds to the example in which the first elastic member 1870 is connected to the bracket 1830. Instead, the first elastic member 1870 can also be connected to the motor housing 1804 as long as the tensile portion 1840 and the rotating portion 1810 can rotate integrally.

Because the first fixing portion 1314 is disposed below the drum 1030, the first elastic member 1870 can be disposed closer to a center of the base 1310 than the motor 1800 in a horizontal direction. In other words, a horizontal distance between the center of the base 1310 and the first elastic member 1870 is smaller than a horizontal distance between the center of the base 1310 and the motor 1800. In this regard, the center of the base 1310 refers to a center in a left and right direction.

When the motor 1800 is located closer to one side surface of the cabinet than to the other side surface of the cabinet, the first elastic member 1870 will be located farther from one side surface of the cabinet than the motor 1800.

When the drum 1030 rotates by the rotation of the motor, the first elastic member 1870 provides a spring force to rotate the dual pulley 1815, the idler pulley 1841, and the bracket 1830 in a direction inclined toward the center of the base 1310, that is, in the preset first rotation direction. The motor housing 1804 can rotate in place by the first elastic member 1870. In this regard, the rotating portion 1810 and the tensile portion 1840, specifically, the support shaft 1806, the dual pulley 1815, the idler pulley 1841, and the bracket 1830 can be integrally tilted by the spring force of the first elastic member 1870. When the motor stops, the tensions applied to the tight side 1861 and the slack side 1862 become equal to each other, so that the rotating portion 1810 and the tensile portion 1840 can return to their original positions.

The rotation preventing portion 1880 can include the second elastic member 1882 having one end connected to the cabinet 1010 or the base 1310 and the other end connected to the rotating portion 1810 or the bracket 1830 such that the rotating portion 1810 and the tensile portion 1840 are rotated in a second rotation direction that is an opposite direction of the first rotation direction. When the rotation preventing portion 1880 is formed in the shape of the second elastic member 1882, a second elastic member connecting portion 1883 for coupling with the base 1310 can be further included at a distal end of the second elastic member 1882 connected to the base 1310.

A second fixing portion 1319 for connecting the second elastic member can be positioned on the base 1310 on a side opposite to the side on which the first fixing portion 1314 is positioned with respect to the motor 1800. Referring to FIG. 5, the second fixing portion 1319 can have a shape of a fixing groove, and the second elastic member connecting portion 1883 can be inserted into and coupled to the second fixing portion. In this regard, the second elastic member connecting portion 1883 and the second fixing portion 1319 can be hook-coupled to each other.

The second elastic member 1882 serves to prevent excessive rotation of the rotating portion 1810 and the tensile portion 1840 caused by the first elastic member 1870. Therefore, an appropriate tension is applied to the drum belt 1860, so that the rotational force will be transmitted without the slip between the drum 1030 and the drum belt 1860.

When the motor 1800 is located closer to one side surface of the cabinet than to the other side surface of the cabinet, the first elastic member 1870 will be located farther from one side surface of the cabinet than the motor 1800. In addition, the second fixing portion 1319 will be located between the motor 1800 and one side surface of the cabinet 1010.

The rotating portion 1810 can rotate integrally with the tensile portion 1840 when rotating in the preset first rotation direction, for example, in a clockwise direction when looking at the motor 1800 from the front of the cabinet 1010, to adjust the tension applied to the drum belt when the motor 1800 rotates.

As described in the present disclosure, when the tensile portion 1840 and the rotating portion 1810 are integrally tilted or return to their original positions, vibration within the laundry treating apparatus 1000 can be reduced. This is because when the tensile portion 1840 and the rotating portion 1810, specifically, the motor housing 1804, the dual pulley 1815, the idler pulley 1841, and the bracket 1830 are individually tilted or individually restored, they can become different vibration sources. As such, when the multiple vibration sources have equal or similar frequencies, resonance can be generated and the laundry treating apparatus 1000 can be greatly shaken.

In addition, as in the present disclosure, when the tensile portion 1840 and the rotating portion 1810, specifically, the motor housing 1804, the dual pulley 1815, the idler pulley 1841, and the bracket 1830 are integrally tilted or return to their original positions, the narrow inner space of the cabinet 1010 can be efficiently utilized. When the motor housing 1804, the dual pulley 1815, the idler pulley 1841, and the bracket 1830 are individually tilted or individually restored, a bracket for supporting each of the components and an elastic member for providing a spring force may be installed individually. This stricture may be provided in a relatively large space, making it difficult to efficiently utilize the narrow inner space of the cabinet 1010.

The laundry treating apparatus 1000 can include the cabinet 1010 that forms the external appearance of the apparatus, the cylindrical drum 1030 located inside the cabinet 1010 and having the open front and rear surfaces, the motor 1800 that generates the rotational force for rotating the drum 1030, the rotation shaft 1801 that rotates by the rotational force generated by the motor 1800, the motor housing 1804 coupled to the outer circumferential surface of the motor 1800, the support shaft 1806 disposed in parallel with the rotation shaft 1801 and coupled to the motor housing 1804, the rotating portion 1810 rotatably disposed on the support shaft 1806, and connected to the motor 1800 with the pulley belt 1850 so as to transmit the rotational force of the motor 1800, the drum belt 1860 that connects the rotating portion and the outer circumferential surface of the drum to each other so as to transmit the rotational force of the motor 1800 to the drum 1030 via the rotating portion 1810, the tensile portion 1840 positioned between the rotating portion 1810 and the drum 1030 so as to adjust the tensile force of the drum belt 1860, the bracket 1830 coupled to the motor housing 1804 and rotatably supporting the tensile portion 1840, the first elastic member 1870 having one end connected to the cabinet 1010 and the other end connected to the motor housing 1804 or the bracket 1830, and rotating the rotating portion 1810 and the tensile portion 1840 in the first rotation direction around the rotation shaft 1801 when the drum 1030 rotates, and the rotation preventing portion 1880 that prevents the motor housing 1804 and the bracket 1830 from rotating by the angle equal to or greater than the predetermined rotation angle in the first rotation direction.

The rotation preventing portion 1880 can be the second elastic member 1882, and the first elastic member 1870 and the second elastic member 1882 can be located on the left and right sides of the motor 1800 so as to be directed in opposite directions based on the position of the motor 1800.

Figure 7:
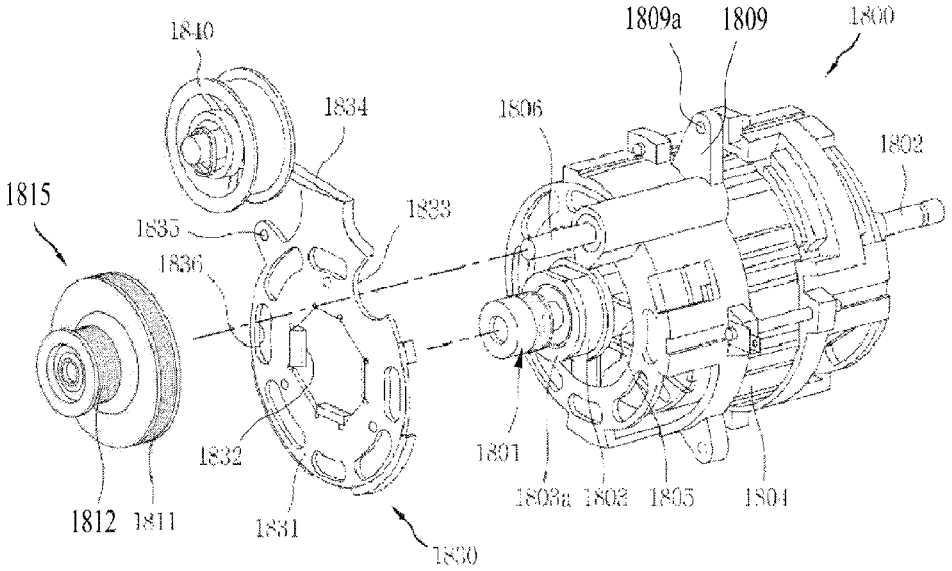
FIG. 7 is an exploded view showing the motor, the rotating portion, the tensile portion, and the bracket.

FIG. 6 is a perspective view showing a mutual coupled state of the motor 1800, the dual pulley 1815, the idler pulley 1841, and the bracket 1830. FIG. 7 is an exploded perspective view showing a separated state of the motor 1800, the dual pulley 1815, the idler pulley 1841, and the bracket 1830.

Referring to FIGS. 6 and 7, the rotating portion 1810 can include the motor housing 1804 coupled to the outer circumferential surface of the motor 1800, the support shaft 1806 disposed in parallel with the rotation shaft 1801 and coupled to the motor housing 1804, the motor pulley 1801*b* coupled to the rotation shaft 1801 and rotating together with the rotation shaft 1801, the first pulley 1811 that rotates by being coupled to the support shaft 1806, the pulley belt 1850 that connects the motor pulley 1801*b* and the first pulley 1811 to each other so as to transmit the rotational force of the motor pulley 1801*b* to the first pulley 1811, and the second pulley 1812 coupled to the support shaft and rotating together with the first pulley 1811.

However, when the pulley belt 1850 is formed as a chain rather than the belt, the motor pulley 1801*b* and the first pulley 1811 can be formed as a chain. Similarly, when the drum belt 1860 is formed as a chain rather than the belt, the second pulley 1812 can also be formed as a chain, and the outer circumferential surface of the drum can also have a shape of a chain ring gear corresponding to the chain.

When the first elastic member 1870 is connected to the bracket 1830 or the motor housing 1804, the bracket 1830 or the motor housing 1804 rotates because of the difference in tension in a portion of the second pulley 1812 of the drum belt 1860, which will be described later, and the first elastic member 1870 when the drum 1030 rotates. Accordingly, the rotating portion 1810 and the tensile portion 1840 can rotate, so that a stronger tension can be applied to the drum belt 1860. This will soon bring an effect of increasing the length of the drum belt 1860.

The dual pulley 1815 can include the first pulley 1811 and the second pulley 1812 having the different diameters in order to reduce the number of rotations provided from the motor 1800 and increase a torque. The first pulley 1811 and the second pulley 1812 are rotatably coupled to the support shaft 1806. Because the pulleys are coupled to each other, the second pulley 1812 will rotate at the same speed as the rotational speed of the first pulley 1811. Alternatively, the first pulley 1811 and the second pulley 1812 can be integrally formed.

The first pulley 1811 can have a larger diameter than the second pulley 1812. A ratio of the diameter of the first pulley 1811 and the diameter of the second pulley 1812 determines a reduction ratio of the driving force.

An unevenness can be formed along an outer circumferential surface of each of the first pulley 1811 and the second pulley 1812. The pulley belt 1850 and the drum belt 1860 are wound on the outer circumferential surfaces of the first pulley 1811 and the second pulley 1812, respectively. The unevenness is to maximize a frictional force so as to prevent loss in the driving force transmitted from the motor.

Steps 1811*a* and 1812*a* for preventing deviation of the pulley belt 1850 and the drum belt 1860 can be formed on both sides of the unevenness. The steps 1811*a* and 1812*a* can be formed along the outer circumferential surfaces of the first pulley 1811 and the second pulley 1812, respectively.

The dual pulley 1815 can further include a hollow 1813 passing through a center of the first pulley 1811 and the second pulley 1812. The support shaft 1806 can be inserted into the hollow 1813, and the dual pulley 1815 can be rotatably coupled to the support shaft 1806. A ball bearing for smooth rotation of the dual pulley 1815 can be installed in the hollow 1813.

Referring to FIGS. 4 to 7 again, the first pulley 1811 is directed in a direction toward the motor housing 1804 (a direction toward the front of the laundry treating apparatus 1000), and the second pulley 1812 is directed in a direction away from the motor housing (a direction toward the rear of the laundry treating apparatus 1000).

The dual pulley 1815 can be connected to the rotation shaft 1801 by the pulley belt 1850 so as to receive the driving force from the motor 1800. The pulley belt 1850 can connect the rotation shaft 1801 and the first pulley 1811 to each other. Accordingly, the rotational force of the rotation shaft 1801 can be transmitted to the first pulley 1811 by the pulley belt 1850, and the first pulley 1811 can rotate by the pulley belt 1850.

The dual pulley 1815 can be connected to the drum 1030 by the drum belt 1860. The drum belt 1860 can be connected to the dual pulley 1815 and the drum 1030 so as to transfer the rotational force or the driving force of the motor 1800 to the drum 1030. In some examples, the drum belt 1860 is wound around the outer circumferential surface of the drum 1030 and the second pulley 1812.

However, alternatively, in order for the rotation the drum 1030, the drum 1030 can include a drum driving shaft disposed at the rear of the drum 1030 so as to rotate the drum 1030 and a drum pulley coupled to the drum driving shaft. In this case, the second pulley 1812 and the drum pulley can be connected to each other by the drum belt 1860.

The bracket 1830 can be installed on the motor housing 1804. The idler pulley 1841 can be installed on the bracket 1830. The bracket 1830 can be coupled to the motor housing 1804. The bracket 1830 can rotatably support the idler pulley 1841.

Figure 8:
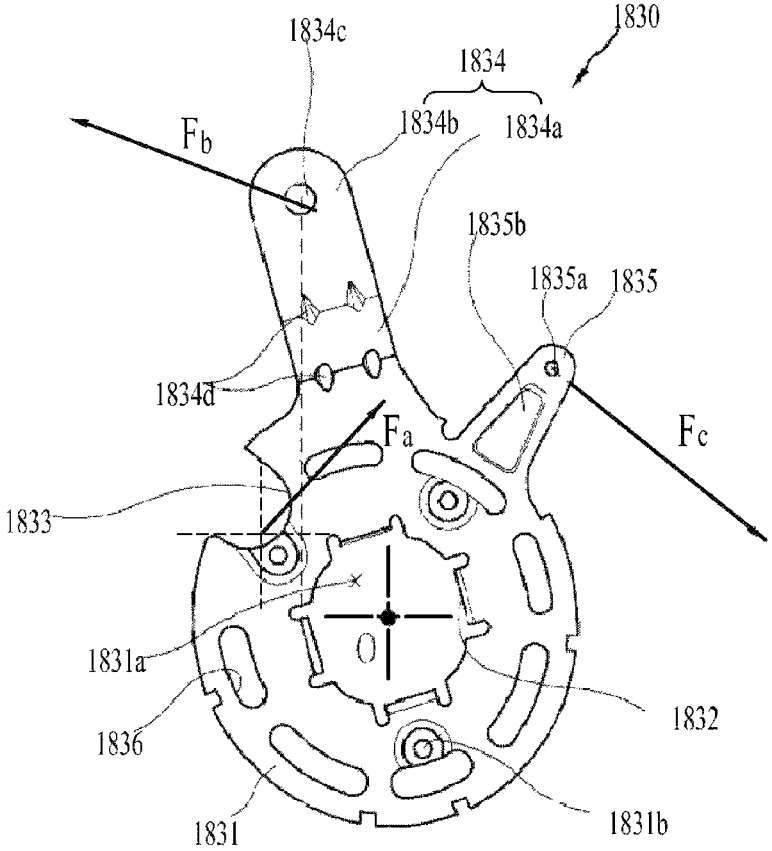
FIG. 8 shows an example of the bracket.

FIG. 8 shows a shape when only the bracket 1830 coupled to the motor housing 1804 is viewed from the front of the laundry treating apparatus 1000. The bracket 1830 can include a housing-coupled portion 1831, a first elastic member-coupled portion 1835, a support shaft receiving hole 1833, and an idler-coupled portion 1834.

The housing-coupled portion 1831 can be coupled to the motor housing 1804, so that the bracket and the motor housing can rotate integrally. Similarly, because the tensile portion 1840 is also connected to the bracket via the idler-coupled portion 1834, the tensile portion 1840 and the rotating portion 1810 can eventually rotate integrally together.

The housing-coupled portion 1831 can cover one side of the motor housing 1804 that is visible when the motor 1800 is viewed from the rear of the laundry treating apparatus 1000. The housing-coupled portion 1831 can have a shape corresponding to said one side of the motor housing 1804. For example, when the motor housing 1804 has a circular column shape as a whole, the housing-coupled portion 1831 can also have a circular shape corresponding to a bottom surface of the column.

A rotation shaft receiving hole 1831*a* (first through-hole) can be defined at a center of the housing-coupled portion 1831. The rotation shaft receiving hole 1831*a* is for passing the rotation shaft 1801 therethrough.

A hook coupling portion 1832 can be formed around the rotation shaft receiving hole 1831*a*. The hook coupling portion 1832 can include a plurality of hook coupling portions. The hook coupling portion 1832 can protrude toward the motor housing 1804 from the circumference of the rotation shaft receiving hole 1831*a*. The hook coupling portion 1832 can include the plurality of hook coupling portions. The hook coupling portion 1832 can be hook-coupled to a hook accommodating portion 1805 defined in one side of the motor housing 1804. The hook accommodating portion 1805 can include a plurality of hook accommodating portions defined around the rotation shaft support 1803.

A screw receiving hole 1831*b* and a vent-hole 1836 can be defined in the housing-coupled portion 1831. The screw receiving hole 1831*b* and the vent-hole 1836 can be defined between the circumference of the rotation shaft receiving hole 1831*a* and an edge of the housing-coupled portion 1831. The term "between the circumference of the rotation shaft receiving hole 1831*a* and the edge of the housing-coupled portion 1831" refers to between an inner diameter and an outer diameter of the housing-coupled portion 1831.

The screw receiving hole 1831*b* is for passing a screw for fixing the bracket 1830 to the motor housing 1804 therethrough. The screw through hole 1831*b* can be defined in a circular shape and can be formed in a smaller size than a head of the screw. The screw receiving hole 1831*b* can include a plurality of screw receiving holes, and the plurality of screw receiving holes can be spaced apart from each other.

The vent-hole 1836 is for discharging heat generated from the motor 1800. The vent-hole 1836 can have an arc shape. The vent-hole 1836 can include a plurality of vent-holes and the plurality of vent-holes can be spaced apart from each other along a virtual circumference. In this regard, the "virtual circumference" refers to concentric circles of the inner diameter and the outer diameter of the housing-coupled portion 1831.

The first elastic member-coupled portion 1835 can protrude from the housing-coupled portion 1831 in a radial direction. When the motor 1800 is not driven, the bracket 1830 maintains a static equilibrium state. In the state in which the bracket 1830 maintains the static equilibrium state, the first elastic member-coupled portion 1835 can protrude in a direction closer to the drum 1030 in both vertical and horizontal directions. This is for the first elastic member 1870 to help the rotation of the tensile portion 1840 and the rotating portion 1810 when the tensile portion 1840 and the rotating portion 1810 integrally rotate because of a difference in tensile force applied to the belt when the drum 1030 rotates.

In the same sense, with the rotation shaft receiving hole 1831*a* as a reference point, a horizontal line extending toward the first elastic member 1870 and the protruding direction of the first elastic member-coupled portion 1835 can form an acute angle.

The first elastic member coupling hole 1835*a* to which the first elastic member 1870 can be coupled can be defined at an end of the first elastic member-coupled portion 1835. When the first elastic member 1870 is formed as the coil spring, a hook attached to an end of the coil spring can be inserted into the first elastic member coupling hole 1835*a*.

The first elastic member-coupled portion 1835 can include a strength reinforcing protrusion 1835*b* protruding in a direction away from the motor housing 1804. The strength reinforcing protrusion 1835*b* can be formed in a region surrounded by an outer edge of the first elastic member-coupled portion 1835. This is because when the strength reinforcing protrusion 1835*b* is formed, the first elastic member-coupled portion 1835 can have a higher strength than when being in a flat plate shape.

The support shaft receiving hole 1833 (second through-hole) can define a region for receiving the support shaft 1806. For example, the support shaft receiving hole 1833 can be defined by being depressed inwardly of the housing-coupled portion 1831 at the edge of the housing-coupled portion 1831. Because the support shaft 1806 is disposed in the region provided by the support shaft receiving hole 1833, the position of the support shaft 1806 will be the same as that of the support shaft receiving hole 1833.

In the state in which the bracket 1830 maintains the static equilibrium state, the position of the support shaft receiving hole 1833 can be illustrated based on the rotation shaft receiving hole 1831*a*. Based on the rotation shaft receiving hole 1831*a*, the support shaft receiving hole 1833 can be defined in a direction horizontally away from the drum 1030 and in a direction vertically closer to the drum 1030. Considering that the drum 1030 is disposed at the center of the cabinet 1010 and the motor 1800 is installed eccentrically below the drum 1030, it can be understood that the support shaft receiving hole 1833 is defined in a direction horizontally facing the sidewall of the cabinet 1010 and defined above the rotation shaft receiving hole 1831*a* in the vertical direction.

In the same sense, with the rotation shaft receiving hole 1831*a* as the reference point, a horizontal line extending toward the first elastic member 1870 and a direction in which the support shaft receiving hole 1833 is directed can form an obtuse angle.

The idler-coupled portion 1834 protrudes from the edge of the housing-coupled portion 1831. The idler-coupled portion 1834 can protrude in a radial direction of the housing-coupled portion 1831 at a location between the first elastic member-coupled portion 1835 and the support shaft receiving hole 1833. The idler-coupled portion 1834 is formed to rotatably support the idler pulley 1841.

The idler-coupled portion 1834 can include a first portion 1834*a* and a second portion 1834*b*. The first portion 1834*a* can be formed by bending and extending from the edge of the housing-coupled portion 1831 in a direction away from the motor housing 1804. The direction away from the motor housing 1804 refers to the rearward direction of the laundry treating apparatus 1000. The first portion 1834*a* can extend in an upwardly inclined direction.

The second portion 1834*b* can be formed by bending and extending from the first portion 1834*a* in the radial direction of the housing-coupled portion 1831. The second portion 1834*b* can extend in the upward direction. The idler pulley 1841 can be rotatably coupled to the second portion 1834*b*. That is, the idler pulley 1841 will be rotatably supported by the second portion 1834*b*. An idler-coupled hole 1834*c* to which the rotation shaft of the idler pulley 1841 can be coupled is defined in the second portion 1834*b*.

A boundary between the housing-coupled portion 1831 and the first portion 1834*a* and a boundary between the first portion 1834*a* and the second portion 1834*b* can be distinguished as a small angle side and a large angle side, respectively. For example, when the first portion 1834*a* is bent 120° from the housing-coupled portion 1831, the small angle side of the housing-coupled portion 1831 and the first portion 1834*a* refers to a boundary where two surfaces forming an angle of 120° meet each other, and the large angle side refers to a boundary where two surfaces forming an angle of 240° meet each other. This is because a sum of the small angle and the large angle is 360°.

A strength reinforcing molded portion 1834*d* for reinforcing the strength of the bracket 1830 can be formed on the idler-coupled portion 1834. The strength-reinforced molded portion 1834*d* can be formed by being subjected to press processing from the large angle side to the small angle side of each boundary, and the strength-reinforced molded portion 1834*d* can protrude from the large angle side to the small angle side. The strength-reinforcing molded portion 1834*d* can include a plurality of strength-reinforcing molded portions and the plurality of strength-reinforcing molded portions can be spaced apart from each other.

Referring to FIG. 8, a force $F_B$ transmitted to the bracket 1830 via the idler-coupled hole 1834*c*, a spring force $F_C$ of the first elastic member 1870 transmitted to the bracket 1830 via the first elastic member coupling hole 1835*a*, and a resultant force $F_A$ of the tension on the tight side and the tension on the slack side transmitted to the second pulley 1812 that is eventually transmitted to the bracket 1830 by being transmitted to the support shaft receiving hole 1833 by the support shaft 1806 are shown. The force transmitted to the bracket 1830 will be transmitted to the motor housing 1804 coupled to the bracket 1830. In some implementations, as shown in FIG. 5, a spring force $F_D$ of the second elastic member 1882 is transmitted to the motor housing 1804, so that the spring force $F_D$ is omitted in FIG. 8. An analysis of a mechanical force for the rotation of the tensile portion 1840 and the rotating portion 1810 when these four forces are transmitted to the motor housing 1804 is illustrated with reference to FIG. 10.

(a) in FIG. 9 is a schematic diagram for illustrating a tension applied to the rotating portion 1810 when the drum stops. (b) in FIG. 9 is a schematic diagram for illustrating a tension applied to the rotating portion 1810 by the drum belt 1860 when the drum 1030 rotates at a normal speed. (c) in FIG. 9 is a schematic diagram for illustrating that a tension applied to a rotating portion by the drum belt 1860 varies when the drum 1030 rotates at the normal speed.

First, (c) in FIG. 9 is an enlarged view of the second pulley 1812 and a portion (a region A) of the drum belt 1860 for connection of the second pulley 1812 in (b) in FIG. 9.

When the rotation shaft 1801 rotates or the drum 1030 rotates, the tension applied to the dual pulley 1815 by the drum belt 1860, that is, more specifically, the tension applied to the second pulley 1812 connected to the drum belt 1860 can be distinguished into a tension Ft on the tight side and a tension Fs on the slack side.

In general, when the belt rotates, the tension of the drum belt 1860 can change based on the second pulley 1812 and the tension can be largely distinguished into two types. That is, the portion of the drum belt 1860 that is tight is referred to as the tight side 1861, and another portion of the drum belt 1860 that is relatively loose is referred to as the slack side 1862. In addition, the tensions applied to the respective sides are referred to as the tight side tension and the slack side tension, respectively.

When the dual pulley 1815 rotates in the clockwise direction (the first rotation direction), the tension difference between the tight side 1861 and the slack side 1862 occurs. Eventually, the rotating portion 1810 and the tensile portion 1840, that is, the second pulley 1812, the support shaft 1806, the motor housing 1804, the bracket 1830, and the idler pulley 1841 can rotate in the clockwise direction around the rotation shaft 1801.

When the drum 1030 rotates at a predetermined rotational speed, the tensile portion 1840 and the rotating portion 1810 rotate in the clockwise direction by a predetermined angle. The larger the angle, the more tension is applied to the drum belt 1860. In such case, the difference between the tight side tension Ft and the slack side tension Fs increases, and the tight side tension and the slack side tension are different from each other in the second pulley 1812, so that a rotational resistance $R_{MP}$ acting in a counterclockwise direction (the second rotation direction) that is an opposite direction of the second pulley 1812 occurs.

The motor 1800 eventually generates a torque capable of overcoming the rotational resistance generated by the second pulley 1812. When the rotational resistance is reduced, the torque will also be reduced. Therefore, only appropriate tension for the rotation of the drum may act.

In some examples, a force capable of generating a torque opposite to the spring force of the first elastic member 1870 and the tension of the drum belt 1860 can be provided by the rotation preventing portion 1880.

Therefore, when the rotation preventing portion 1880, for example, the second elastic member 1882 is disposed, even when the tensile portion 1840 and the rotating portion 1810 rotate, they are prevented from rotating by the angle equal to or greater than the predetermined rotation angle, so that the tension applied to the drum belt 1860 will not become a value equal to or higher than a certain value.

As a result, because the torque to be generated by the motor 1800 can be reduced by adding the second elastic member 1882 compared to the case in which only the first elastic member 1870 is present, energy for the rotation of the drum 1030 is reduced.

(a) in FIG. 9 shows the tension applied to the drum belt 1860 when the drum 1030 is stopped. In some examples, the tension by the drum belt 1860 surrounding the outer circumferential surface of the drum 1030 can be constant in all portions in the non-rotating state of the drum. Only a direction of the tension indicated along the outer circumferential surface of the drum 1030 is different, and a magnitude thereof is indicated the same.

Referring to (b) in FIG. 9, as described above, when the drum 1030 rotates, the tight side tension Ft and the slack side tension Fs become different from each other. Therefore, in addition to the rotational resistance $R_{MP}$ generated in the dual pulley 1815, a rotational resistance RP of the drum will be generated in the counterclockwise direction.

Referring to (a) in FIG. 9, rollers **1060*a* and 1060*b* for guiding the rotation of the drum 1030 can be positioned on the outer circumferential surface of the drum 1030. When the rollers are able to include the first roller 1060*a* and the second roller 1060*b*, one pair of first rollers can be disposed near the front supporter 1040 and one pair of second rollers can be disposed near the rear supporter 1050** of the drum, respectively.

In addition, in order to suppress the slip phenomenon between the drum 1030 and the drum belt 1860, a maximum contact angle can be secured between the drum 1030 and the drum belt 1860. A contact angle $\theta_D$ (see (a) in FIG. 11) of the drum 1030 and the drum belt 1860 refers to an angle between a portion where the tight side 1861 of the drum belt 1860 is in contact with the drum 1030 and a portion where the slack side 1862 of the drum belt 1860 is in contact with the drum 1030 with respect to the center of the drum 1030.

The contact angle between the drum 1030 and the drum belt 1860 is determined based on a distance between the drum 1030 and the dual pulley 1815 and a position of the idler pulley 1841. As the distance between the drum 1030 and the dual pulley 1815 decreases, the contact angle will increase. Further, as the idler pulley 1841 presses the slack side 1862 of the drum belt 1860 closer to the tight side 1861, the contact angle will increase.

In some implementations, because the dual pulley 1815 and the idler pulley 1841 are installed on the bracket 1830, the contact angle between the drum 1030 and the drum belt 1860 can be determined based on a shape of the bracket 1830. In some examples, the contact angle between the drum 1030 and the drum belt 1860 can be equal to or greater than 270° (degrees).

FIG. 10 shows a free body diagram of four major forces applied to the tensile portion 1840 and the rotating portion 1810.

Referring to FIG. 8, locations of the first elastic member 1870, the support shaft 1806, and the idler pulley 1841 can be determined based on shapes of the first elastic member-coupled portion 1835, the support shaft receiving hole 1833, and the idler-coupled portion 1834 defined in the bracket 1830.

As a result, the tension applied to the drum 1030 via the drum belt 1860 can be calculated based on the bracket 1830. However, the second elastic member 1882 can be connected to the bracket 1830 or to the motor housing 1804. Because the tensions in both of the cases are forces for rotating in the clockwise direction or the counterclockwise direction on a two-dimensional plane, a description will be able to be made based on a center O of the rotation shaft.

(a) in FIG. 10 shows a case in which only the first elastic member 1870 is disposed as in an existing laundry treating apparatus. This is for comparison with (b) in FIG. 10 showing a case in which the second elastic member 1882 is disposed as the rotation preventing portion 1880.

In this case, three major forces will be involved in the rotation of the rotating portion 1810 and the tensile portion 1840. Therefore, a sum of moments $M_1$ with respect to the center of the rotation shaft or the center O of rotation caused by the tension applied to the drum belt 1860 and the spring force of the first elastic member 1870 can be calculated as in Equation 1 below. A position where the rotation center O of the motor 1800 is formed can be the same position as the rotation shaft 1801. Each symbol represents a vector, and an operation expression X refers to a cross product of the vectors.

$$\Sigma M_1 = r_A \times F_A + r_C \times F_C - r_B \times F_B \quad \text{[Equation 1]}$$

Here, $r_A$ is a position vector from the rotation center O of the motor 1800 to a diametrical center of the second pulley 1812 or a diametrical center of the support shaft 1806.

$r_B$ is a position vector from the rotational center O of the motor 1800 to a diametrical center of the idler pulley 1841.

$r_C$ is a position vector from the rotation center O of the motor 1800 to an arbitrary point of the first elastic member 1870 when the first elastic member 1870 is assumed to be a single line.

$F_A$ denotes a force vector applied to the second pulley 1812 by a sum of the tensions of the drum belt 1860 affecting the second pulley 1812.

$F_B$ is a force by a sum of tensions of the drum belt 1860 applied to the idler pulley 1841.

$F_C$ is a force applied by the spring force of the first elastic member 1870.

When the motor 1800 does not rotate, it is the static equilibrium. In this case, the sum of the moments $M_1$ with respect to the center O of the rotation in Equation 1 will be zero.

Here, unlike $F_A$ and $F_C$, because $F_B$ has a different direction, $F_B$ will act in the opposite direction in the moment (or the torque), so that $F_B$ is indicated by a minus (−) in Equation 1.

(b) in FIG. 10 shows the case with the second elastic member 1882. In this case, the spring force by the second elastic member 1882 acts in opposition to the three forces described above. A sum of moments $M_2$ with respect to the center of the rotation shaft or the center O of the rotation can be calculated as in Equation 2 below. A position where the rotation center O of the motor 1800 is formed can be the same position as the rotation shaft 1801.

$$\Sigma M_2 = r_A \times F_A + r_C \times F_C - r_B \times F_B - r_D \times F_D \quad \text{[Equation 2]}$$

Each symbol represents the vector, and the operation expression X refers to the cross product of the vectors.

$r_A$ is the position vector from the rotation center O of the motor 1800 to the diametrical center of the second pulley 1812 or the diametrical center of the support shaft 1806.

$r_B$ is the position vector from the rotational center O of the motor 1800 to the diametrical center of the idler pulley 1841.

$r_C$ is the position vector from the rotation center O of the motor 1800 to the arbitrary point of the first elastic member 1870 when the first elastic member 1870 is assumed to be the single line.

$r_D$ is a position vector from the rotation center O of the motor 1800 to an arbitrary point of the second elastic member 1882 when the second elastic member 1882 is assumed to be a single line.

$F_A$ denotes the force vector applied to the second pulley 1812 by the sum of the tensions of the drum belt 1860 affecting the second pulley 1812.

$F_B$ is the force by the sum of tensions of the drum belt 1860 applied to the idler pulley 1841.

$F_C$ is the force applied by the spring force of the first elastic member 1870.

$F_D$ is a force applied by the spring force of the second elastic member 1882.

Therefore, the torque of the motor will be reduced by the second elastic member 1882 compared to the case where only the first elastic member 1870 is present.

In addition, with Equation 2 above, the tension for suppressing the occurrence of the slip phenomenon between the drum 1030 and the drum belt 1860 and effectively transmitting the driving force of the motor 1800 to the drum 1030 can be calculated by adjusting the variables of the above equations.

Here, unlike $F_A$ and $F_C$, because $F_B$ and $F_D$ have a different direction, $F_B$ and $F_D$ will act in the opposite direction in the moment (or the torque), so that $F_B$ and $F_D$ are indicated by a minus (−) in Equation 2.

In an initial state in which the motor 1800 does not rotate, the laundry accommodated in the drum 1030 will generally be wet laundry that has been washed. Therefore, the position of the drum will be determined by a weight of the wet laundry and a weight of the drum.

Forces applied to the tensile portion 1840 and the rotating portion 1810 will experience a transient state until the motor 1800 reaches a target speed, which is a preset rotational speed, from the stopped state.

The first elastic member 1870 can connect the bracket 1830 or the motor housing 1804 to the base 1310 in a state in which a length thereof is increased to some extent. This is to give appropriate tension such that the slip does not occur between the drum belt 1860 and the drum 1030 by overcoming $F_B$ acting by the idler and rotating the rotating portion 1810 and the tensile portion 1840 in the clockwise direction when the motor 1800 starts to rotate from the stopped state.

Accordingly, $F_C$, which is the spring force by the first elastic member 1870, decreases in magnitude when the tensile portion 1840 and the rotating portion 1810 rotate in the clockwise direction to some extent. This is because the first elastic member 1870 restores an original length thereof without any spring force.

On the other hand, $F_D$, which is the spring force by the second elastic member 1882, is provided so as to prevent excessive inclination of the tensile portion 1840 and the rotating portion 1810 caused by the spring force of the first elastic member 1870. Thus, initially no force can act. Alternatively, the second elastic member 1882 can be connected to initially have some spring force. Thereafter, as the tensile portion 1840 and the rotating portion 1810 rotate in the clockwise direction, the spring force by the second elastic member 1882 gradually increases, so that the second elastic member 1882 can prevent the rotation of the tensile portion 1840 and the rotating portion 1810 by the angle equal to or greater than the preset rotation angle resulted from the first elastic member.

When the rotational speed of the drum 1030 reaches the target speed and the drum 1030 becomes to be in the normal state, the rotation angle will be maintained by the four forces because much torque may not be provided unlike during starting and it is enough that the slip does not occur.

Considering such initial state, transient state, and normal state, the first elastic member 1870 can be selected to have an appropriate tensile force such that the slip resulted from rapid acceleration does not occur during the initial startup. A modulus of elasticity and a length of the second elastic member 1882 can be selected so as to satisfy the condition that the second elastic member 1882 has almost no spring force at the initial start-up and does not slip in the normal state.

In other words, the spring force of the first elastic member 1870 and the spring force of the second elastic member 1882 can be considered in a direction of reducing the motor torque by reducing the tension difference between the tight side 1861 and the slack side 1862 in the normal state so as to reduce the rotational resistance of the dual pulley 1815 and the motor pulley 1801*b*.

In the normal state, the target speed of the drum 1030 can be 55 rpm (revolutions per minute), for example. In addition, it can be set that it takes 6.9 seconds or more from the initial stop state to reaching the target speed.

Referring back to FIGS. 4 to 8, the idler pulley 1841 can be rotatably coupled to the bracket 1830. The idler pulley 1841 will rotate together with the drum belt 1860.

In one example, the idler pulley 1841 can linearly move along a rotation shaft of the idler pulley 1841 coupled to the idler-coupled portion 1834. A direction of the linear movement of the idler pulley 1841 refers to a horizontal direction in which the idler pulley 1841 approaches the motor 1800 or moves away from the motor 1800. Even when the drum belt 1860 is not disposed at a designed position or twisted, when the motor 1800 operates, the drum belt 1860 can be moved to the designed correct position by the linear movement of the idler pulley 1841.

As described above, when the drum 1030 stops and then starts to rotate by the drum belt 1860, the tensile portion 1840 and the rotating portion 1810 can rotate in the clockwise direction by the angle equal to or greater than the predetermined angle by the sum of the moments based on the four major forces. When the speed of the drum 1030 reaches the predetermined rotational speed, the tension by the drum belt can become also constant, so that the tensile portion 1840 and the rotating portion 1810 will not rotate the angle equal to or greater than the predetermined angle. However, as described above, the rotation angle of the tensile portion 1840 and the rotating portion 1810 when only the first elastic member 1870 is present will be greater than the rotation angle of the tensile portion 1840 and the rotating portion 1810 when the second elastic member 1882 is also present.

Depending on the angles at which the tensile portion 1840 and the rotating portion 1810 are rotated, it can be determined whether the tension is applied such that the drum belt is maintained tight or is loosened and sags.

(a) in FIG. 11 illustrates a length of a drum belt formulaically. (b) in FIG. 11 is a graph showing that a drum belt is tensioned and relaxed based on a rotation angle of a rotation shaft. (c) in FIG. 11 is a diagram for definition of a rotation angle of a bracket and a tensile portion when a drum rotates.

For example, (a) in FIG. 11 shows the above-mentioned contact angle $\theta_D$, that is, an angle of a portion where the drum belt 1860 and the outer circumferential surface of the drum 1030 actually contact each other. Therefore, a theoretical length of the drum belt 1860 can be calculated by summing all of a length $ARC_D$ of an arc of the drum calculated using the contact angle and a radius of the drum, a linear distance $L_C$ from a point at which the drum belt 1860 starts to separate from the outer circumferential surface of the drum 1030 to a point at which the drum belt 1860 comes into contact with the idler pulley 1841, a linear distance $L_A$ from the point at which the drum belt 1860 starts to separate from the outer circumferential surface of the drum 1030 to a point at which the drum belt 1860 comes into contact with the dual pulley 1815 or the second pulley 1812, a length $ARC_D$ of an arc at which the drum belt 1860 is in contact with the second pulley 1812, a linear distance $L_B$ from a point at which the drum belt 1860 starts to separate from the second pulley 1812 to a point at which the drum belt 1860 comes into contact with the idler pulley 1841 again, and a length $ARC_I$ of an arc at which the drum belt 1860 is in contact with the idler pulley 1841. That is, a relational expression of the length of the drum belt$=L_A+L_B+L_C+ARC_D+ARC_P+ARC_I$ will be satisfied.

(c) in FIG. 11 illustrates definition of an axial rotation angle at which the tensile portion 1840 and the rotating portion 1810 rotate in the first rotation direction. The positions where the tensile portion 1840 or the idler pulley 1841 and the support shaft receiving hole 1833 are formed in the bracket 1830 can vary, but they are inclined by a certain angle with respect to a vertical line passing through the center O of the rotation shaft as illustrated. When such position is referred to as an initial position, when the motor 1800 is rotated to rotate the drum 1030, the tensile portion 1840 and the rotating portion 1810 will rotate in the first rotation direction. The angle of rotation at this time can be defined as the axial rotation angle and can be referred to as $\theta$.

Depending on the axial rotation angle, the length of the drum belt 1860 ($L_A+L_B+L_C+ARC_D+ARCP+ARC_I$) can change. When a length of the drum belt when the axial rotation angle is 0 degrees (deg), that is, when the motor 1800 is stopped is referred to as an initial length, a drum belt length change amount can be defined as a value of the length of the drum belt based on the axial rotation angle minus the initial length.

(b) in FIG. 11 shows an example of the amount of change in the length of the drum belt 1860 based on the axial rotation angle. This is because although an actual specific calculated value can change depending on sizes of the drum, the idler, and the dual pulley and relative positions of the idler and the dual pulley, a general length change will follow the open shape shown in (b) in FIG. 11.

In (b) in FIG. 11, the initial length is indicated by a straight line and the amount of change in the drum belt length is indicated by a dotted line. A general shape of the dotted line can be approximated in a form of a quadratic curve. When the axial rotation angle is 0° (degree), there is no change in the length of the drum belt, so that the amount of change in the length of the drum belt is also zero. When the axial rotation angle increases, the length of the drum belt theoretically increases, so that the amount of change in the drum belt length has a positive value, which is a region of R2.

In some cases, when the axial rotation angle is achieved in the counterclockwise direction, the amount of change in the length of the drum belt has a negative value, which can be expressed as a region of R1. The amount of change in the length of the drum belt can be the negative value when the drum belt is not actually contracted, but the drum belt eventually loosens and no tension is applied thereto. This means that the slip can occur in the drum belt 1860 soon without the motor 1800 rotating the drum 1030.

Therefore, because the appropriate tension is provided for the motor 1800 to rotate the drum 1030, the axial rotation angle may be achieved in the clockwise direction such that the change amount of the drum belt length has the positive value. However, when the axial rotation angle is excessively large, too much tension is applied to the drum belt. As described above, this will increase the rotational resistance of the motor pulley and the drum belt, so that the torque value of the motor 1800 may be increased to rotate the drum 1030, which can result in energy waste.

Therefore, in order not to rotate by the angle equal to or greater than the preset rotation angle, a force pulling the tensile portion 1840 and the rotating portion 1810 in a direction opposite to the direction of the spring force of the first elastic member 1870 can be provided by the rotation preventing portion 1880.

When the drum rotates at the target speed that is the preset rotational speed, the rotation angle can be determined at a point where the sum of the moments in Equation 2 becomes zero. For example, the rotation angle can be set to greater than 0 degrees and equal to or smaller than 2 degrees.

FIG. 12 shows a cross-section taken along a line SS' in FIG. 5. FIG. 12 shows that the rotation preventing portion 1880 is formed as a stopper 1884 instead of the second elastic member 1882. That is, the laundry treating apparatus 1000 can include the stopper 1884 to prevent the motor housing 1804 and the bracket 1830, that is, the rotating portion 1810 and the tensile portion 1840 from rotating by the angle equal to or greater than the predetermined rotation angle when the motor housing 1804 and the bracket 1830 are rotated in the first rotation direction by the tension of the drum belt 1860 and the spring force of the first elastic member 1870.

The stopper 1884 can be located on the base 1310 on the same side as the side on which the first elastic member 1870 is located with respect to the motor 1800. Further, the motor housing 1804 can include a housing protrusion 1804*a* protruding in the radial direction of the motor housing 1804 to stop the rotation by the stopper. The housing protrusion 1804*a* can be formed at a position where the housing protrusion 1804*a* meets the stopper 1884 when the tensile portion 1840 and the rotating portion 1810, that is, the bracket 1830 and the motor housing 1804 rotate by the preset rotation angle.

An example in which the stopper 1884 is located on the base 1310 outside the motor mounting portion 1313 is shown, but the stopper 1884 can be located on a sidewall of the motor mounting portion 1313 otherwise.

The stopper 1884 can be made of a material that absorbs impact such as a rubber material to reduce impact when in contact with the housing protrusion 1804*a*.

The present disclosure can be modified and implemented in various forms, so that the scope of rights is not limited to the above-described implementation. Therefore, when the modified implementation includes components of the claims of the present disclosure, it should be viewed that the modified implementation belongs to the scope of the present disclosure.

What is claimed is:

1. A laundry treating apparatus comprising:

a cabinet defining an external appearance of the laundry treating apparatus;

a drum located inside the cabinet, the drum having an open front surface and an open rear surface;

a motor configured to generate a rotational force for rotating the drum;

a rotating portion configured to be rotated by the rotational force of the motor;

a connecting portion that connects the rotating portion and the drum to each other and is configured to transfer the rotational force of the motor to the drum through the rotating portion;

a tensile portion disposed between the rotating portion and the drum and configured to adjust a tension of the connecting portion;

a bracket that is connected to the rotating portion and rotatably supports the tensile portion;

a first elastic member having a first end connected to the cabinet and a second end connected to the rotating portion or the bracket, the first elastic member being configured to rotate the rotating portion and the tensile portion in a first rotation direction based on rotation of the drum; and a rotation preventing portion configured to limit a rotation angle of the rotating portion and the tensile portion in the first rotation direction to be less than a predetermined rotation angle.

2. The laundry treating apparatus of claim 1, wherein the rotation preventing portion comprises a second elastic member having a first end connected to the cabinet and a second end connected to the rotating portion or the bracket, the second elastic member being configured to rotate the rotating portion and the tensile portion in a second rotation direction opposite to the first rotation direction.

3. The laundry treating apparatus of claim 2, wherein the second elastic member is located closer to one side surface of the cabinet than to another side surface of the cabinet.

4. The laundry treating apparatus of claim 3, wherein the first elastic member and the second elastic member are located at opposite sides with respect to the motor.

5. The laundry treating apparatus of claim 4, wherein the rotating portion and the tensile portion are configured to be disposed at original positions, respectively, before being rotated in the first rotation direction, and wherein the rotating portion and the tensile portion are configured to, based on the drum being stopped, be rotated in the second rotation direction by the second elastic member to thereby return to the original positions, respectively.

6. The laundry treating apparatus of claim 2, wherein the first elastic member is configured to, based on the drum rotating at a preset target speed, apply a first spring force to the rotating portion or the bracket, and wherein the second elastic member is configured to, based on the drum rotating at the preset target speed, apply a second spring force to the rotating portion or the bracket, the second spring force being greater than the first spring force.

7. The laundry treating apparatus of claim 6, wherein the rotation angle of the rotating portion and the tensile portion is greater than 0 degrees and less than or equal to 2 degrees based on the drum rotating at the preset target speed.

8. The laundry treating apparatus of claim 2, wherein the rotating portion comprises a motor housing that accommodates the motor, and wherein the second end of the first elastic member and the second end of the second elastic member are coupled to the motor housing.

9. The laundry treating apparatus of claim 1, further comprising a rotation shaft configured to be rotated by the rotational force of the motor, wherein the rotating portion comprises:

a motor housing coupled to an outer circumferential surface of the motor;

a support shaft that is parallel to the rotation shaft and coupled to the motor housing;

a motor pulley coupled to the rotation shaft and configured to rotate together with the rotation shaft;

a first pulley coupled to the support shaft and configured to rotate based on rotation of the motor pulley;

a pulley belt that connects the motor pulley to the first pulley and is configured to transfer a rotational force of the motor pulley to the first pulley; and a second pulley coupled to the support shaft and configured to rotate together with the first pulley.

10. The laundry treating apparatus of claim 9, wherein a diameter of the first pulley is greater than a diameter of the second pulley.

11. The laundry treating apparatus of claim 10, wherein the connecting portion comprises a drum belt that connects an outer circumferential surface of the drum and the second pulley to each other.

12. The laundry treating apparatus of claim 11, wherein a length of the drum belt is configured to increase based on rotation of the drum.

13. The laundry treating apparatus of claim 12, wherein the tensile portion comprises an idler pulley configured to increase a contact angle between the drum belt and the outer circumferential surface of the drum.

14. The laundry treating apparatus of claim 13, wherein the drum belt is configured to, based on rotation of the drum, define (i) a tight side moving into the idler pulley and (ii) a slack side moving out of the idler pulley, and wherein the drum belt is configured to have a first tension applied to the slack side and a second tension applied to the tight side, the second tension being different from the first tension.

15. The laundry treating apparatus of claim 1, further comprising:

a rotation shaft configured to be rotated by the rotational force of the motor; and a base that defines a bottom surface of the cabinet, wherein the rotating portion comprises:

a motor housing coupled to an outer circumferential surface of the motor, a support shaft that is parallel to the rotation shaft and coupled to the motor housing, a motor pulley coupled to the rotation shaft and configured to rotate together with the rotation shaft, a first pulley coupled to the support shaft and configured to rotate based on rotation of the motor pulley, a pulley belt that connects the motor pulley and the first pulley to each other and is configured to transfer a rotational force of the motor pulley to the first pulley, and a second pulley coupled to the support shaft and configured to rotate together with the first pulley, wherein the motor comprises a rotation shaft support that surrounds a circumference of the rotation shaft and rotatably supports the rotation shaft, and wherein the base comprises a motor support that protrudes from the base and supports the rotation shaft support to thereby enable the rotation shaft support to rotate by the rotation angle in the first rotation direction together with the bracket.

16. The laundry treating apparatus of claim 15, wherein the bracket comprises:

a housing-coupled portion fixed to a side of the motor housing, the housing-coupled portion defining:

a first through-hole that receives the rotation shaft and the rotation shaft support, and a second through-hole that is recessed from an outer surface of the housing-coupled portion toward the first through-hole and receives the support shaft; and a tensile portion-coupled portion that extends from the outer surface of the housing-coupled portion in a direction away from the first through-hole and rotatably supports the tensile portion.

17. The laundry treating apparatus of claim 16, wherein the bracket further comprises a first coupled portion that protrudes from the housing-coupled portion and is coupled to the first elastic member, the first coupled portion being located between the first elastic member and the second through-hole.

18. The laundry treating apparatus of claim 15, wherein the rotation preventing portion comprises a stopper located at the motor support and configured to limit a rotation angle of the rotation shaft support to be less than the rotation angle of the rotating portion and the tensile portion.

19. The laundry treating apparatus of claim 1, wherein the rotation preventing portion comprises a stopper disposed adjacent to the first elastic member, the stopper comprising a protrusion configured to limit a rotation angle of the rotating portion, the tensile portion, and the bracket to be less than the predetermined rotation angle based on the rotating portion, the tensile portion, and the bracket rotating in a direction toward the first elastic member.

20. The laundry treating apparatus of claim 1, wherein the rotating portion comprises a plurality of pulleys and a pulley belt that connects the motor to the plurality of pulleys, wherein the tensile portion comprises an idler pulley disposed between the drum and the plurality of pulleys and spaced apart from the plurality of pulleys, and wherein the connecting portion comprises a drum belt that extends along at least a portion of the plurality of pulleys, the idle pulley, and an outer circumferential surface of the drum.

* * * * *